US009790767B2

(12) United States Patent
Zhou

(10) Patent No.: US 9,790,767 B2
(45) Date of Patent: Oct. 17, 2017

(54) SYSTEM FOR MULTI-ZONE WELL TEST/PRODUCTION AND METHOD OF USE

(71) Applicant: Saudi Arabian Oil Company, Dhahran (SA)

(72) Inventor: Shaohua Zhou, Dhahran Hills (SA)

(73) Assignee: Saudi Arabian Oil Company, Dhahran (SA)

( * ) Notice: Subject to any disclaimer, the term of this patent is extended or adjusted under 35 U.S.C. 154(b) by 284 days.

(21) Appl. No.: 14/623,798

(22) Filed: Feb. 17, 2015

(65) Prior Publication Data

US 2015/0240598 A1 Aug. 27, 2015

Related U.S. Application Data

(60) Provisional application No. 61/944,369, filed on Feb. 25, 2014.

(51) Int. Cl.

| | |
|---|---|
| ***E21B 17/18*** | (2006.01) |
| ***E21B 34/14*** | (2006.01) |
| ***E21B 33/128*** | (2006.01) |
| ***E21B 34/10*** | (2006.01) |
| ***E21B 43/16*** | (2006.01) |
| ***E21B 43/12*** | (2006.01) |
| ***E21B 43/14*** | (2006.01) |
| *E21B 34/00* | (2006.01) |

(52) U.S. Cl.

CPC ..... *E21B 34/14* (2013.01); *E21B 17/18* (2013.01); *E21B 33/1285* (2013.01); *E21B 34/10* (2013.01); *E21B 43/12* (2013.01); *E21B 43/14* (2013.01); *E21B 43/16* (2013.01); *E21B 2034/007* (2013.01)

(58) Field of Classification Search

CPC ..... E21B 34/14; E21B 43/14; E21B 43/12; E21B 33/1285; E21B 34/10; E21B 43/16; E21B 2034/007; E21B 17/18

See application file for complete search history.

(56) References Cited

U.S. PATENT DOCUMENTS

| | | | |
|---|---|---|---|
| 3,680,637 | A | 8/1972 | Raulins |
| 5,482,123 | A | 1/1996 | Collee |
| 5,887,657 | A | 3/1999 | Bussear et al. |
| 5,934,371 | A | 8/1999 | Bussear et al. |

(Continued)

FOREIGN PATENT DOCUMENTS

| | | | |
|---|---|---|---|
| GB | 2 062 066 | A | 5/1981 |

OTHER PUBLICATIONS

PCT The International Search Report and The Written Opinion of the International Searching Authority dated Jun. 29, 2015; International Application No. PCT/US2015/017038; International Filing Date: Feb. 23, 2015.

*Primary Examiner* — Brad Harcourt

(74) *Attorney, Agent, or Firm* — Bracewell LLP; Constance G. Rhebergen; Keith R. Derrington

(57) ABSTRACT

A multi-zone well test system, that can flow test multiple zones within a subterranean formation and without the use of a rig. The system includes an inflow control tool that is ball actuated, a top diverter sub, a zonal isolation packer, a bottom diverter sub, and a dual-conduit tubing system. An advantage of the test system is that the subs and packers can be individually actuated without a surface operated control system.

21 Claims, 16 Drawing Sheets

(56) References Cited

U.S. PATENT DOCUMENTS

| | | | | |
|---|---|---|---|---|
| 6,321,842 | B1 | 11/2001 | Pringle | |
| 6,343,651 | B1 | 2/2002 | Bixenman | |
| 7,114,582 | B2 | 10/2006 | Eppink et al. | |
| 7,343,983 | B2 | 3/2008 | Livingstone | |
| 8,286,703 | B2 | 10/2012 | Clapp et al. | |
| 8,657,015 | B2 | 2/2014 | Patel | |
| 2005/0224228 | A1 | 10/2005 | Livingstone | |
| 2009/0301716 | A1 | 12/2009 | Johnson | |
| 2012/0241154 | A1* | 9/2012 | Zhou | E21B 33/146 166/285 |

* cited by examiner

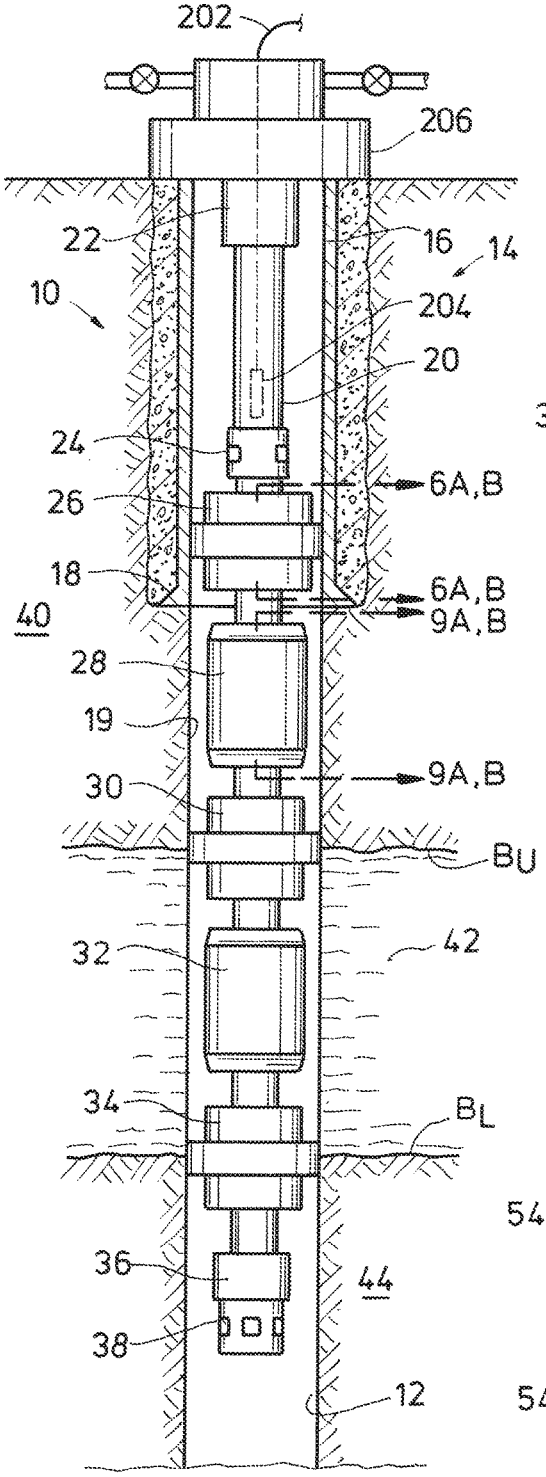
FIG.1
FIG.3A
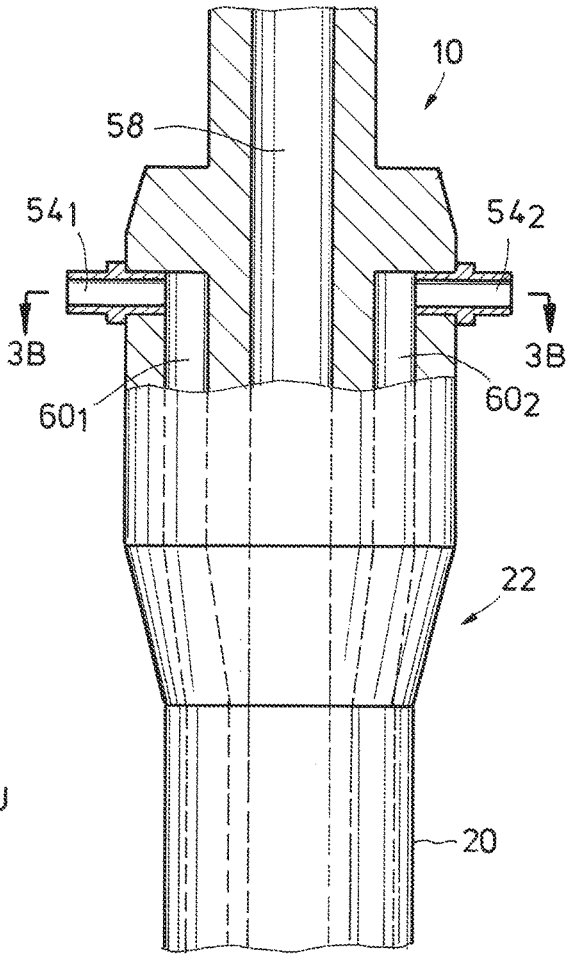
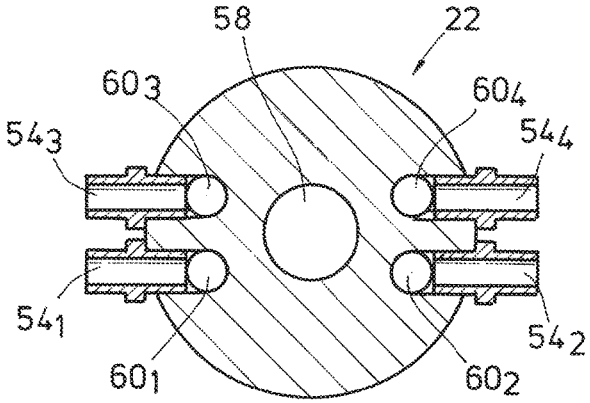
FIG.3B

36
$60_2$
156
$60_1$ $60_2$
70
20
58
36
184
$60_1$ $60_1$
$60_2$
$60_4$
58
$60_3$
22
70
178

58
70
13B
22
182
180
13B
20
72

58
200
194
196
186
38

58
190
188

58
190
186

58
188
190
192
194
186

58
198
200
38

SYSTEM FOR MULTI-ZONE WELL TEST/PRODUCTION AND METHOD OF USE

CROSS-REFERENCE TO RELATED APPLICATIONS

This application claims priority to and the benefit of U.S. Provisional Application Ser. No. 61/944,369, filed Feb. 25, 2014, the full disclosure of which is hereby incorporated by reference herein for all purposes.

BACKGROUND OF THE INVENTION

1. Field of Invention

The present disclosure relates in general to a system and method of well testing, and producing at multiple zones.

2. Description of Prior Art

Typically, when drilling an exploration well, a production type casing string is run and cemented above the target zone. After pressure tests of the cemented casing to ensure wellbore integrity, continued drilling is carried out into the target zone with carefully monitoring trip/connection gas together with surface mud logging to record penetrated formation lithology. Usually a decision is made to cut core samples when promising and potential reservoir rock types are encountered, afterwards continued drilling is carried out to well total depth, then wireline logs are run to identify porous/permeable zone and formation fluid types. If the formation evaluation from the above mentioned data acquisition (mud logging, wireline logs and core samples) indicates a potential reservoir, a barefoot well test is conducted subsequently to determine its economic potential. Post well test operation, if a decision is made to deepen the well to access deeper zone of interest, then a liner has to be run and cemented to isolate the tested zone (if hole size is allowed post liner installation). The whole process of formation evaluation in the deeper zone is repeated.

If a cased hole well test in the target zone is implemented due to concerns of well control risks, then to allow deepening of the well for exploring deep zones of interest, the perforated zones across the cased hole section have to be isolated and wellbore pressure integrity has to be ensured before proceeding to the next step. This may be achieved by squeezing perforated zones with cement, if unsuccessful with restoring wellbore integrity, a casing patch or liner has to be run (if post installation hole size is sufficient), in some cases a sidetrack operation from the above tested zone may be conducted, consequently a large amount of rig operating time and associated cost incur unavoidably before even reaching the planned secondary target zone.

SUMMARY OF THE INVENTION

Disclosed herein is an example of a tool string for use in a wellbore and which includes a tubing string, a main bore axially formed in the tubing string, lateral bores disposed radially outward from the main bore and that are axially formed in a sidewall of the tubing string, an inlet formed radially through the sidewall of the tubing that intersects at least one of the lateral bores, a packer on the tubing string that is selectively expandable into sealing contact with a wall of the wellbore to define a pressure barrier in an annulus between the tubing string and the wall of the wellbore, and an inflow control sub on the tubing string. In this example the inflow control sub is made up of ports projecting radially through the sidewall from the main bore to an outer surface of the tubing string and a sleeve coaxially slidable in the main bore with openings that selectively register with the ports to provide communication between the main bore and the outer surface of the tubing string. The tool string further includes an actuator in a one of the lateral bores and that is coupled with the inflow control sub and that selectively delivers an axial sliding force to the sleeve. In an example the actuator includes an annular seat coaxially disposed in the one of the lateral bores, a passage that projects radially through the tubing string between the one of the lateral bores and to adjacent the sleeve, so that when the seat is moved axially away from the passage, pressure from the one of the lateral bores communicates to the sleeve to urge the sleeve axially to an open position so that the openings register with the ports. An annular piston can be included with the tool string that is coupled with the sleeve and that has an end in communication with the passage, so that when the pressure from the one of the lateral bores communicates to the sleeve, an axial force is applied to the piston for urging the piston that in turn urges the sleeve to the open position. The actuator can have an annular seat coaxially disposed in the one of the lateral bores, a passage that projects radially through the tubing string between the one of the lateral bores and to adjacent the sleeve, so that when the seat is moved axially away from the passage, pressure from the one of the lateral bores communicates to the sleeve to urge the sleeve axially to a closed position so that the openings are moved out of registration with the ports. This example can further include an annular piston coupled with the sleeve and that has an end in communication with the passage, so that when the pressure from the one of the lateral bores communicates to the sleeve, an axial force is applied to the piston for urging the piston that in turn urges the sleeve to the closed position. The tool string can also have an annular space on an end of the piston distal from the end that is in communication with the passage, a chemical tracer in the annular space, and a discharge port projecting radially through the sleeve adjacent the annular space, so that when the piston is urged by the axial force, the chemical tracer is injected into the main bore. Inlet ports can be provided at upper ends of the lateral bores and that selectively receive balls that are dropped into the lateral bores. An alternative embodiment has a sleeve assembly with an upper sleeve having slots in a sidewall that selectively register with radial ports formed in the sidewall of the tubing string. The packer can be a casing packer having an elastomeric member that projects radially outward and into sealing contact with an inner surface of casing in the wellbore. The packer can be an open hole packer having an elastomeric member that projects radially outward and into sealing contact with an uncased surface of the wellbore. A valve can be set between the main bore and a space inside of the elastomeric member, wherein the valve comprises a plug having a side facing the main bore, compressible disks on a side of the plug opposite the main bore, a spring axially disposed in a chamber formed the sidewall of the main bore and adjacent the compressible disks, so that when pressure in the main bore exceeds a designated pressure, a radially outward force is exerted onto the plug to compress the disks and urge the plug adjacent the spring, wherein the spring axially urges the plug into an opening and blocks communication between the main bore and the space inside of the elastomeric member. The tool string may have a recess in the sidewall spaced axially away from the passage and that selectively receives the seat within. Optionally provided is a spring that axially biases seat, so that when the seat is received within the recess and expands radially outward, a ball landed on the seat passes through the seat and the spring urges the seat to an original location above the recess. When a ball is dropped into the one of the lateral bores and lands on the seat, a fluid seal can be formed between the ball and the seat, so that when pressure is applied to a space above the ball, a force is generated to urge the ball and the seat axially within the one of the lateral bores.

Also disclosed is a method of using a tool string in a wellbore that includes providing a tubing string having, a main bore, lateral bores in a sidewall of the tubing string, a packer in selective communication with the main bore, and a flow sub, disposing the tubing string into the wellbore, and selectively creating a path of communication between the main bore and an annulus between the tubing string and wellbore by pressurizing one of the lateral bores. The one of the lateral bores can be a first lateral bore, the method further include inserting a ball into an upper end of the first bore and that lands in a ball seat provided in the first bore. The step of pressurizing can involve communicating pressure in one of the lateral bores to a piston that couples to a sleeve that circumscribes the main bore, so that the communicated pressure axially urges the sleeve to a location that registers an opening in the sleeve with a port in the tubing string thereby communicating the main bore with the annulus. In the example method, fluid can be injected into the annulus through the flow sub. Optionally, fluid can be produced from the annulus into the flow sub. The packer can be deployed by communicating pressure in the lateral bores to a space between the packer and the tubing string. Communicating pressure can involve providing a pressure actuated valve in the sidewall of the tubing string that actuates at a designated pressure.

BRIEF DESCRIPTION OF DRAWINGS

Some of the features and benefits of the present invention having been stated, others will become apparent as the description proceeds when taken in conjunction with the accompanying drawings, in which:

FIG. 1 is a partial side sectional view of an example of a tool string in a wellbore and in accordance with the present invention.

FIGS. 3A and 3B are side and axial sectional views of an example of a dual conduit diverter portion of the tool string of FIG. 1 and in accordance with the present invention.

Figure 2:
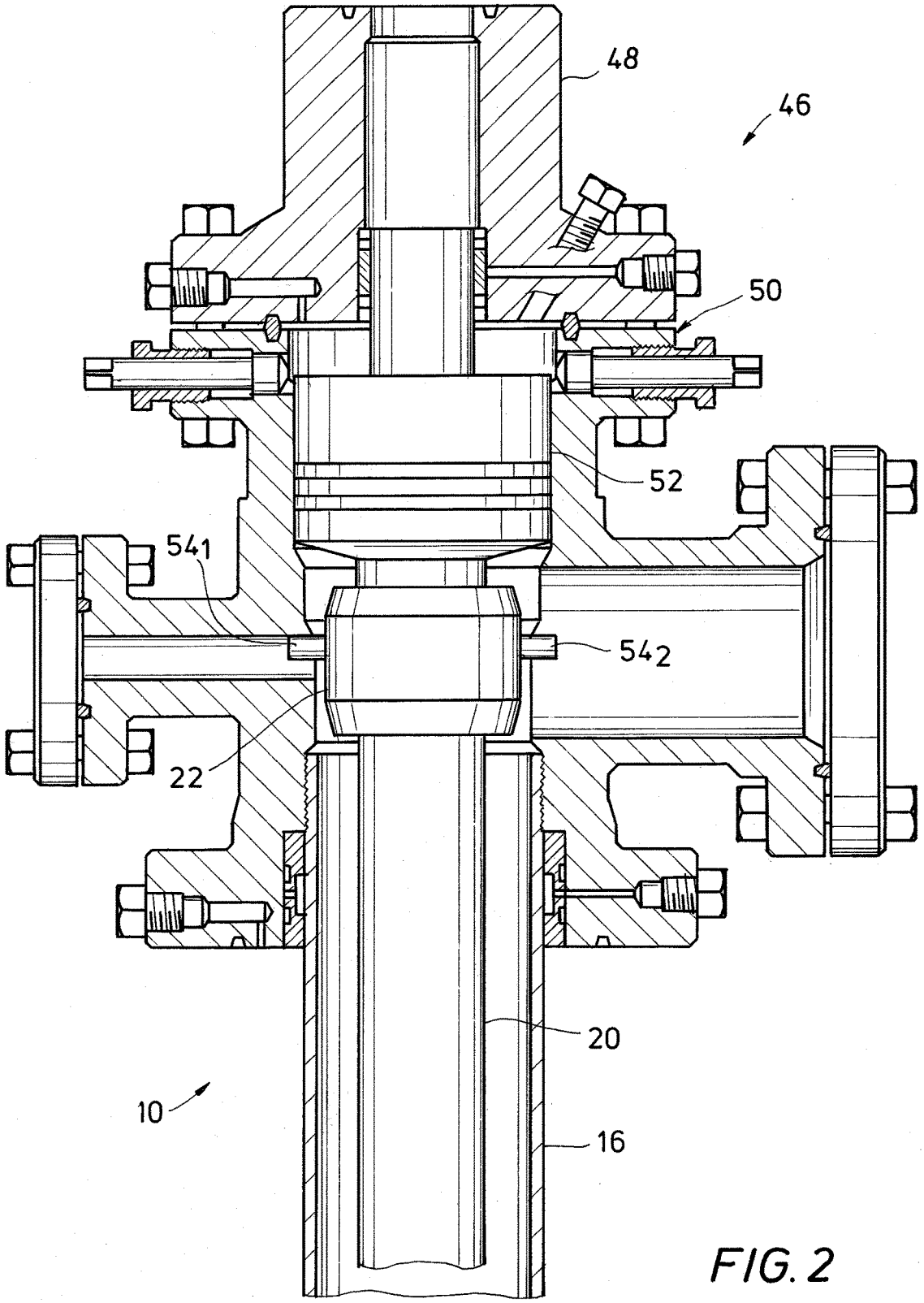
FIG. 2 is a partial side sectional view of an example of a wellhead assembly for use with the tool string of FIG. 1 and in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in side sectional view in FIG. 1 is one example of a tool string 10 set within a wellbore 12, where wellbore 12 is axially formed through a subterranean formation 14. In the example of FIG. 1, a portion of wellbore 12 is lined with casing 16. A casing shoe 18 is mounted on the bottom terminal end of the string of casing 16. Below casing shoe 18 is an open hole configuration with an open hole wellbore wall 19. The tool string 10 includes a tubing string 20 with a dual conduit diverter 22 mounted on its upper end. Mounted on the tool string 10 in sequential order are sleeve assembly 24, cased hole packer 26, inflow control sub 28, open hole packer 30, inflow control sub 32, open hole packer 34, diverter sub 36, and bottom sub 38. Bottom sub 38 is shown mounted on the lower terminal end of tubing string 20.

In the example of FIG. 1, the subterranean formation 14 is shown segmented to have an upper test zone 40, an intermediate test zone 42 below upper test zone 40, and lower test zone 44 below intermediate test zone 42. An upper border $B_U$, which defines a boundary between upper and intermediate test zones 40, 42 is illustrated at about the same depth as open hole packer 30. A lower border $B_L$ is shown at about the same depth as open hole packer 34 and which defines a boundary between intermediate and lower test zones 42, 44.

Shown in side sectional view in FIG. 2, is a one example of a wellhead assembly 46 from which tool string 10 is deployed. Wellhead assembly 46 includes an annular tubing bonnet 48 on its upper end and that mounts on a tubing head 50. Tubing hanger 52 is landed in an inner annulus within tubing head 50 and lateral ports $\mathbf{54}_1$, $\mathbf{54}_2$ are shown projecting radially outward from lateral sides of dual conduit diverter 22; where dual conduit diverter 22 is shown disposed within the tubing head 50. An upper end of casing 16 depends from a lower end of the wellhead assembly 46 and shown circumscribing tubing string 20.

Referring now to FIG. 3A, shown in a side sectional view is an example of the dual conduit diverter 22 and in which a main bore 58 axially extends through the dual conduit diverter 22. Moreover, the main bore 58 extends substantially the axial length of the tool string 10. Shown radially offset from and generally parallel with the main bore 58 are lateral bores $\mathbf{60}_1$, $\mathbf{60}_2$; upper ends of the lateral bores $\mathbf{60}_1$, $\mathbf{60}_2$ intersect and communicate respectively with ports $\mathbf{54}_1$, $\mathbf{54}_2$. In this example, a distance set axially below ports $\mathbf{54}_1$, $\mathbf{54}_2$, the outer diameter of the dual conduit diverter 22 is reduced and transitions to the tubing string 20. An axial view of the dual conduit diverter 22 is shown in FIG. 3B and taken along lines 3B-3B of FIG. 3A. In this example, it is shown that in addition to lateral bores $\mathbf{60}_1$, $\mathbf{60}_2$, provided in the body of the dual conduit diverter 22 are lateral bores $\mathbf{60}_3$, $\mathbf{60}_4$, which communicate respectively with ports $\mathbf{54}_3$, $\mathbf{54}_4$. In the example of FIG. 3B, the lateral bores $\mathbf{60}_3$, $\mathbf{60}_4$ extend axially within dual conduit diverter 22 and generally parallel with main bore 58. Ports $\mathbf{54}_3$, $\mathbf{54}_4$ project radially outward from the upper ends of lateral bores $\mathbf{60}_3$, $\mathbf{60}_4$.

Figure 4B:
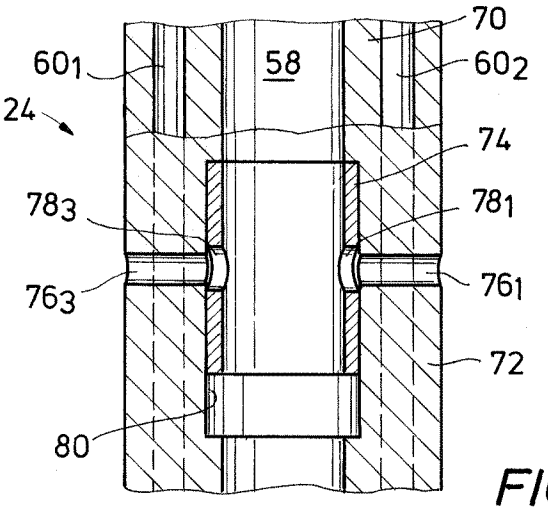
FIGS. 4A, 4B, 5A and 5B are axial and side sectional views of an example of a sleeve assembly portion of the tool string of FIG. 1 and in accordance with the present invention.
Figure 5B:
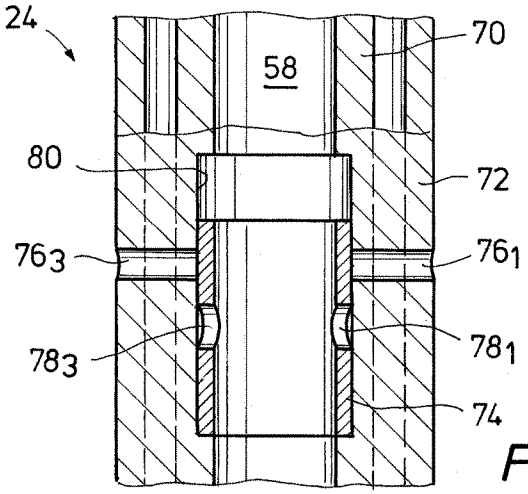
Figure 4A:
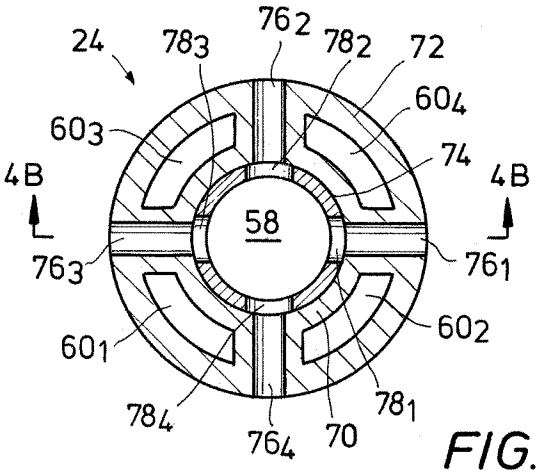
Figure 5A:
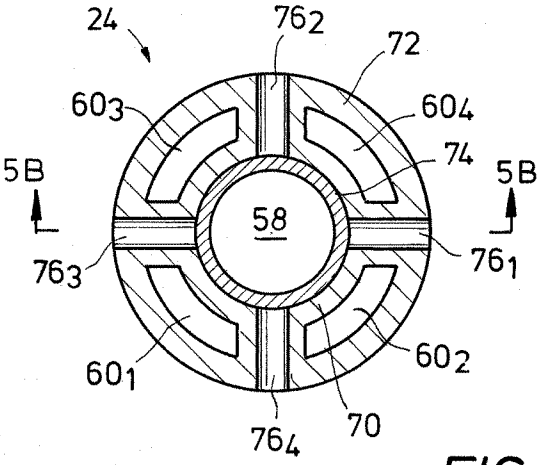

FIGS. 4A and 4B illustrate axial and side sectional views respectively of an example of sleeve assembly 24. Illustrated in axial view in FIG. 4A sleeve assembly 24 is bisected by main bore 58 and has an inner tubular 70 circumscribed by outer tubular 72. An open space between the inner and outer tubular 70, 72 is occupied by lateral bores $\mathbf{60}_1$, $\mathbf{60}_2$, $\mathbf{60}_3$, $\mathbf{60}_4$. Inserted within inner tubular 70 is an annular upper sleeve 74. Radial ports $\mathbf{76}_1$, $\mathbf{76}_2$, $\mathbf{76}_3$, $\mathbf{76}_4$ formed radially through inner and outer tubulars 70, 72 are shown registered with slots $\mathbf{78}_1$, $\mathbf{78}_2$, $\mathbf{78}_3$, $\mathbf{78}_4$ that are formed radially through the side wall of upper sleeve 74. As shown in side sectional view in FIG. 4B, slots $\mathbf{78}_1$, $\mathbf{78}_3$ extend axially a distance along a mid-portion of upper sleeve 74. Lateral bores $\mathbf{60}_1$, $\mathbf{60}_2$ are shown in dashed outline and are not intersected by slots $\mathbf{78}_1$, $\mathbf{78}_3$. Upper sleeve 74 is axially movable within a recess 80 formed on an inner circumference and along an axial distance of inner tubular 70. FIGS. 5A and 5B illustrate an example of sleeve assembly 24 where upper sleeve 74 has moved into a closed position thereby blocking communication between ports $\mathbf{76}_1$, $\mathbf{76}_2$, $\mathbf{76}_3$, $\mathbf{76}_4$ and main bore 58. Shown in side sectional view in FIG. 5B, upper sleeve 74 has moved axially downward within recess 80 so that slots $\mathbf{78}_1$, $\mathbf{78}_3$ are not adjacent to or in registration with ports $\mathbf{76}_1$, $\mathbf{76}_2$, $\mathbf{76}_3$, $\mathbf{76}_4$ formed radially through inner and outer tubulars 70, 72 are shown registered with a solid portion of upper sleeve 74 is adjacent radial ports $\mathbf{76}_1$, $\mathbf{76}_3$ thereby blocking flow between ports $\mathbf{76}_1$, $\mathbf{76}_3$ and main bore 58. As will be described in further detail below, upper sleeve 74 is selectively moveable between the open and closed positions with a wireline or slickline device 202. When in the open position of FIGS. 4A and 4B, communication between the main bore 58 and the annular space between the tool string 10 and casing 16 (FIG. 1) is provided through the registered ports $\mathbf{76}_1$, $\mathbf{76}_2$ and slots $\mathbf{78}_1$, $\mathbf{78}_3$. Thus in one example, when packer 26 is deployed into sealing engagement with casing 16 and ports $\mathbf{76}_1$, $\mathbf{76}_2$ are registered with slots $\mathbf{78}_1$, $\mathbf{78}_3$, fluid flowing down main bore 58 can exit through the registered ports $\mathbf{76}_1$, $\mathbf{76}_2$ and slots $\mathbf{78}_1$, $\mathbf{78}_3$ and enter the annulus between the tool string 10 and casing 16.

Figure 6A:
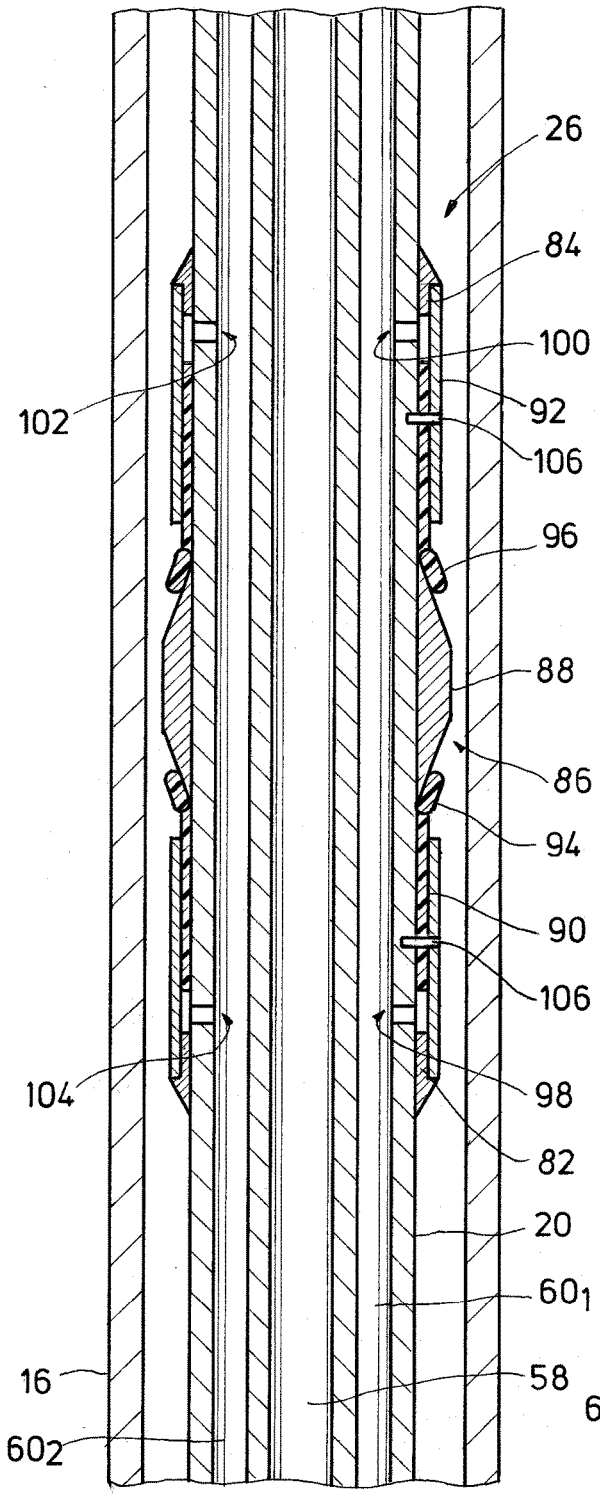
FIGS. 6A and 6B are side sectional views of an example of a packer assembly portion of the tool string for use with a cased portion of a wellbore and in accordance with the present invention.
Figure 6B:
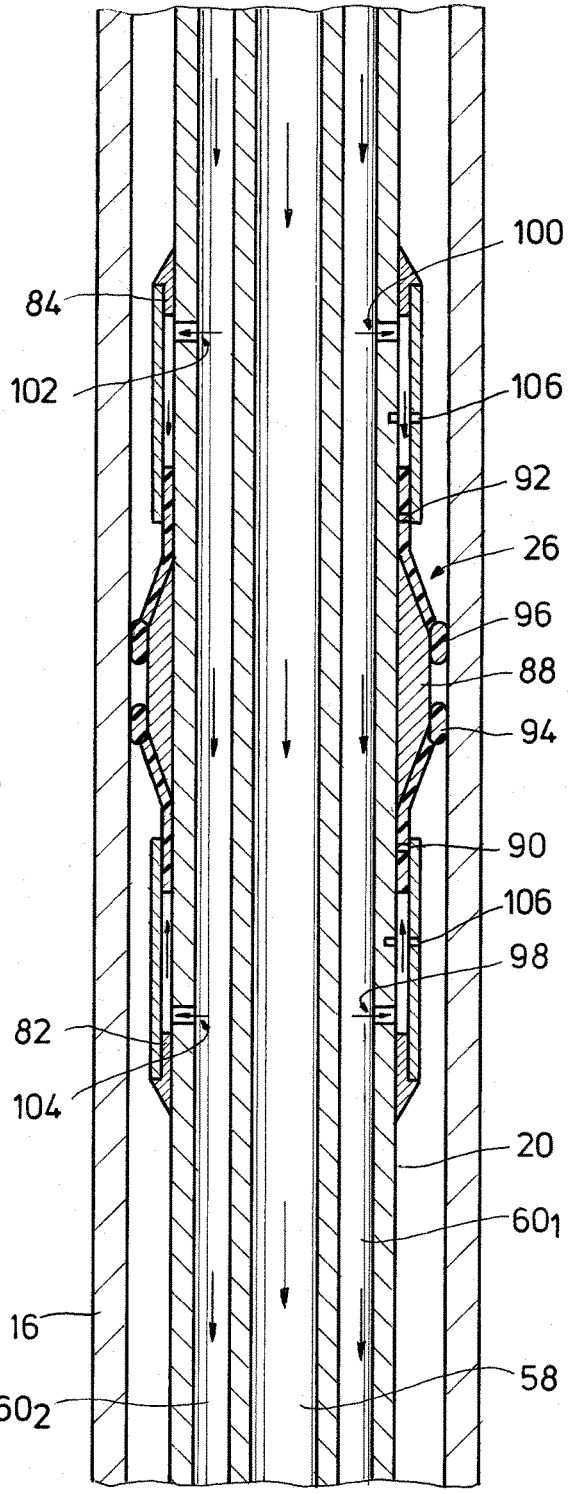

FIG. 6A illustrates an example of cased hole packer 26 in an unset configuration that is for use within casing 16. Here, annular collars 82, 84 are shown that are axially spaced away from one another, and which circumscribe tubing string 20. An annular packer assembly 86 is mounted on and circumscribes the tubing string 20 between collars 82, 84. Packer assembly 86 includes a mid-portion 88, which may be formed from a non-elastomer or metal material, and which has packer ends 90, 92 that extend axially away from one another in opposing directions. The packer ends 90, 92 insert respectively in annular spaces formed between collars 82, 84 and outer surface of tubing string 20. The collars 82, 84 secure the ends 90, 92 to the tubing string 20. Circumscribing the mid portion 88 are a pair of axially spaced apart packer elements 94, 96; which as shown in FIG. 6B, are ring like elements that selectively project radially outward and into sealing contact with an inner surface of casing 16 when the packer assembly 86 is set.

When in the set configuration, packer assembly 86 provides a pressure and fluid barrier in the annulus between the tubing string 20 and casing 16. In one example of deploying the packer assembly 86, fluid flows through ports 98, 100, 102, 104 shown through the side wall of tubing string 20. As shown, the ports 98, 100, 102, 104 register with the annular space between collars 82, 84 and tubing string 20 so that fluid flowing through ports 98, 100, 102, 104 (illustrated by arrows) can fill that annular space. Shown in FIG. 6A, are optional shear pins 106 that project radially through the collars 82, 84 and ends 92, 90 to couple the ends 92, 90 with collars 82, 84. When changing from the unset to the set configuration, as illustrated in the example of FIG. 6B, shear pins 106 are sheared by movement of the ends 90, 92, but have sufficient strength to retain the packer assembly in a desired configuration absent the applied pressure from fluid within the lateral port $\mathbf{60}_1$, $\mathbf{60}_2$.

Figure 7A:
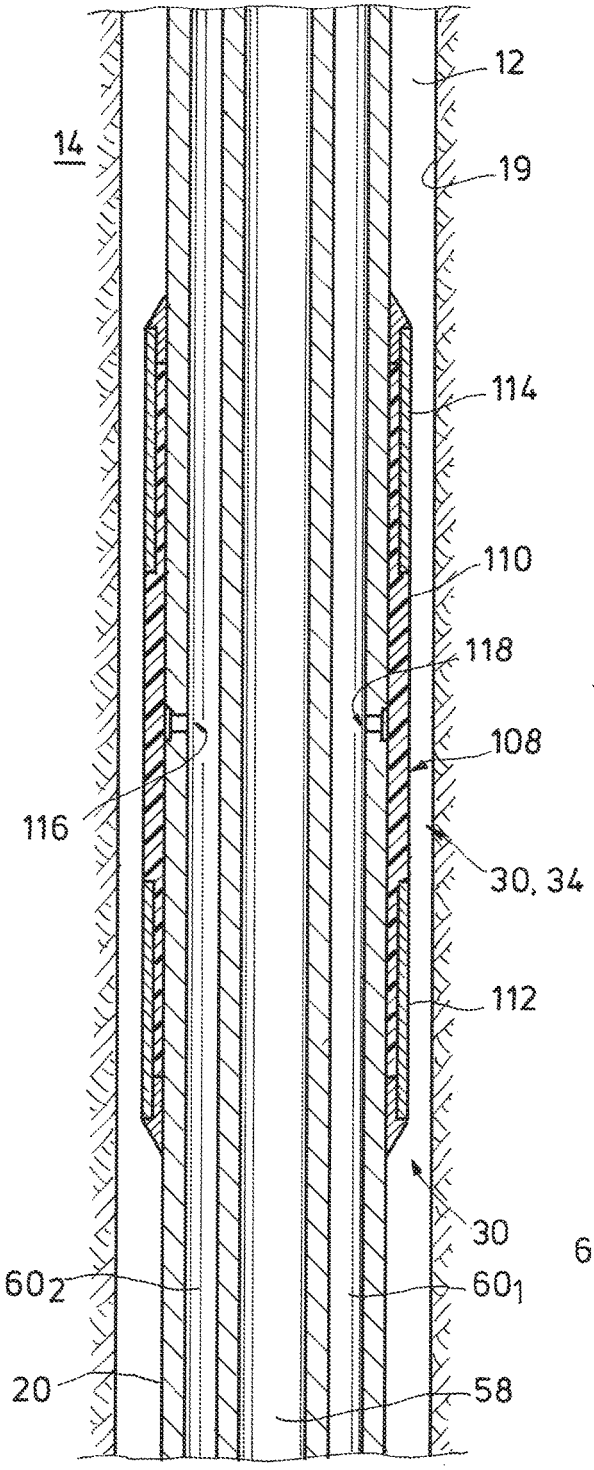
FIGS. 7A and 7B are side sectional views of an example of a packer assembly portion of the tool string for use with an open hole portion of a wellbore and in accordance with the present invention.
Figure 7B:
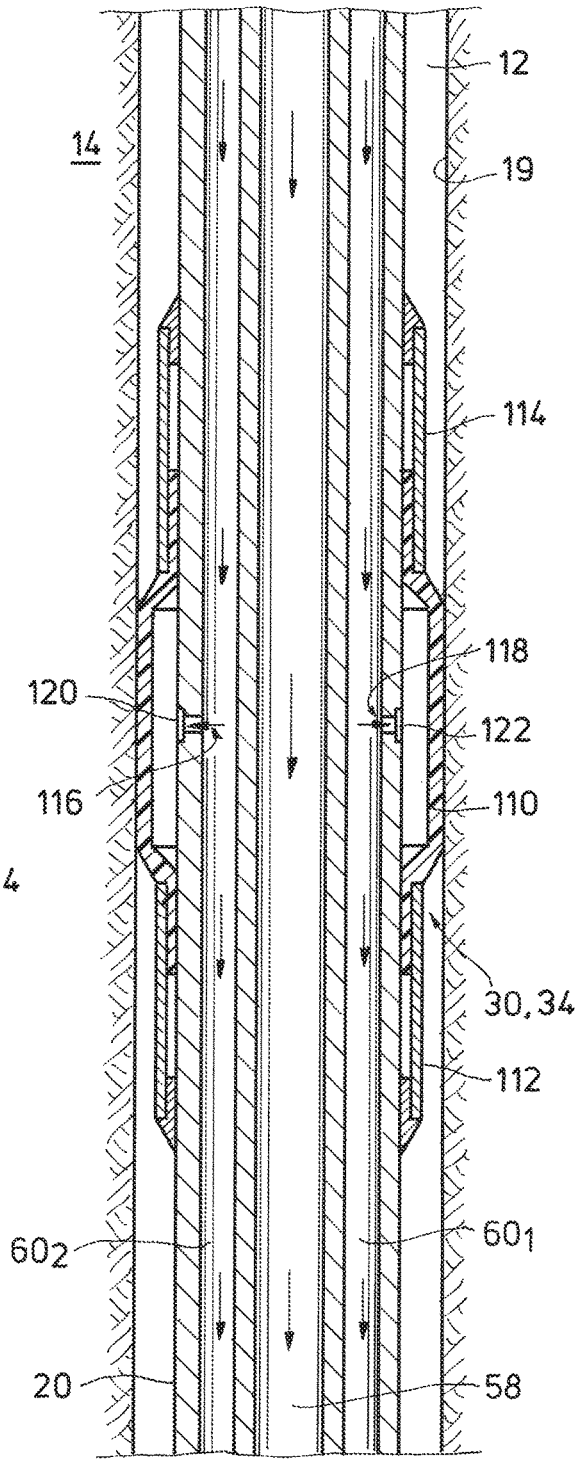

FIGS. 7A and 7B show in a side sectional view of an example of the open hole packer 30, 34, wherein in FIG. 7A, packer 34 is in an unset configuration and in FIG. 7B packer 30, 34 is in a set configuration. In the example of FIG. 7A open hole packer 30, 34 includes a packer assembly 108 on the outer surface of tubing string 20. One element of packer assembly 108 is a packer element 110, which in an embodiment is a tubular shaped elastomeric member. Ends of the packer element 110 are held respectively by axially spaced apart packer collars 112, 114, which are similar to the packer of FIG. 6A, 6B, and retain the ends even when fluid pressure is applied between the tubing string 20 and inside of packer 110. As shown in FIG. 7B, fluid from within lateral bores $\mathbf{60}_1$, $\mathbf{60}_2$ enters the space between tubing string 20 and packer element 110 to move packer element 110 radially outward and into contact with the wall 19 of the open portion of wellbore 12. Fluid enters the space between tubing string 20 and packer element 110 through ports 116, 118 shown projecting radially through the sidewall of tubing string 20.

Figures 8A, 8B, 8C:
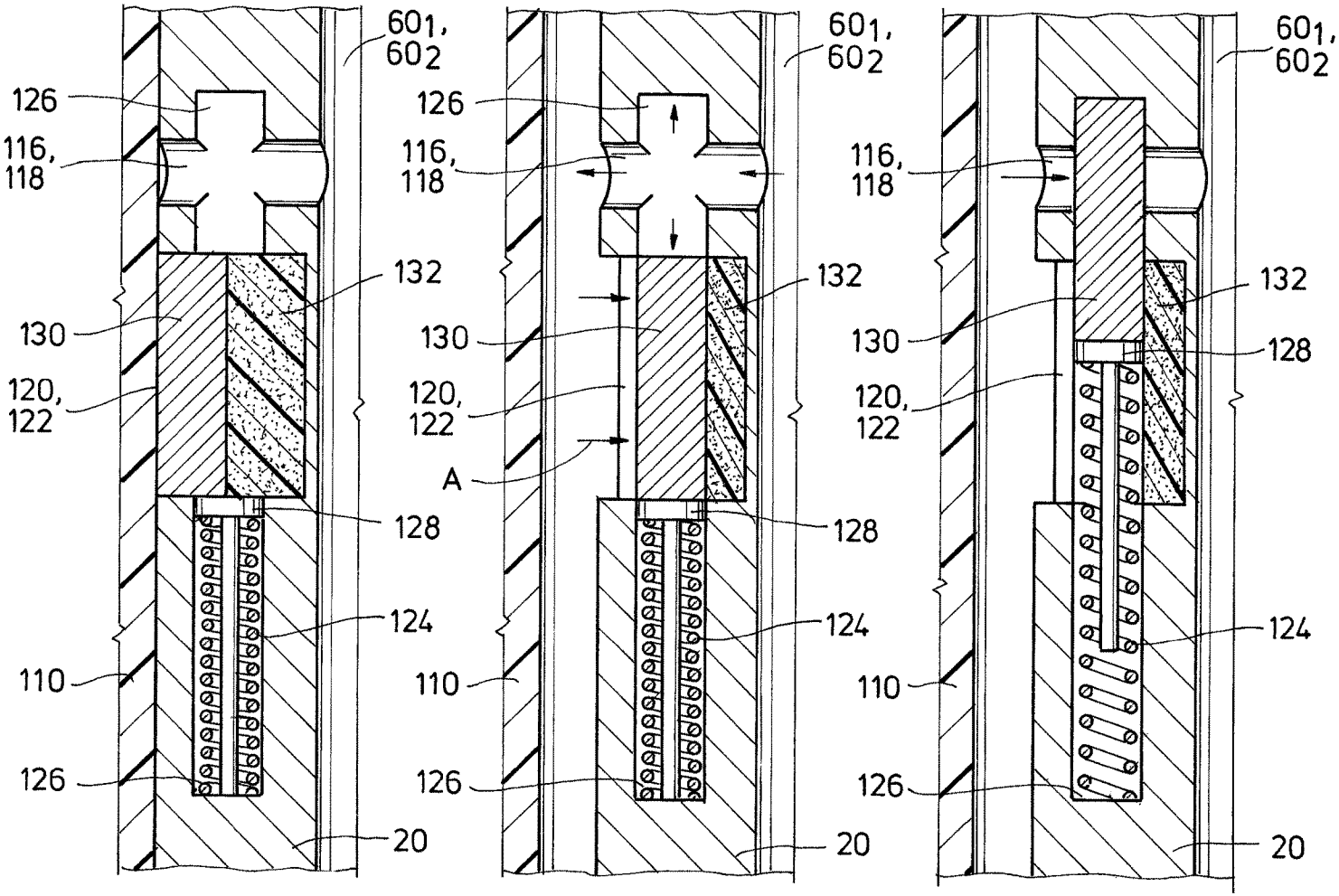
FIGS. 8A-8C are side sectional views of an example of a valve closing a port in a side of the tool string of FIG. 1 and in accordance with the present invention.

Associated with ports 116, 118 are valves 120, 122 which are for retaining pressure in the annular space between packer element 110 and tubing string 20. FIG. 8A through 8C show in side sectional view an example of operation of valves 120, 122. More specifically, in the example of FIG. 8A through 8C, valves 120, 122 are formed in a side wall of tubing string 20 and each include a spring 124 that is set axially within a chamber 126 that extends axially within a wall of tubing string 20. Spring 124, which is shown is in a compressed configuration in FIG. 8A, has one end in a terminal wall of chamber 126 and an opposite end in contact with a disk 128, where disk is coaxially set in chamber 26 and distal wall of chamber 126. Chamber 126 has a diameter that increases on a side of disk 128 opposite spring 124 and opens to lateral bore $\mathbf{60}_1$, $\mathbf{60}_2$, where the intersection of cavity 126 and lateral bore $\mathbf{60}_1$, $\mathbf{60}_2$, defines an enlarged portion of the cavity 126. A plate 130 is in the enlarged portion of cavity 126, and is illustrated being urged radially inward and toward lateral bore $\mathbf{60}_1$, $\mathbf{60}_2$ by compressible disks 132. Compressible disks 132 are set radially outward on a side of plate 130 and in the enlarged portion of cavity 126. Cavity 126 intersects with port 116, 118 on side of enlarged portion distal from spring 124.

Referring now to FIG. 8B, pressure represented by arrows A forces plug 130 radially outward to move compressible disks 132 into the compressed configuration. When in the compressed configuration, plug 130 aligns with an opening to the portion of cavity 126 adjacent ports 116, 118. As such, plug 130 is axially moveable so that spring 124 may expand as shown in FIG. 8C and urge plug 130 axially into the portion of cavity 126 adjacent ports 116, 118. In the configuration of FIG. 8C, plug 130 is in the portion of cavity 126 adjacent ports 116, 118 and blocks pressure and fluid communication between lateral bores $\mathbf{60}_1$, $\mathbf{60}_2$ and the annular space defined between the outer surface of tubing string 20 and packer element 110.

Figure 9A:
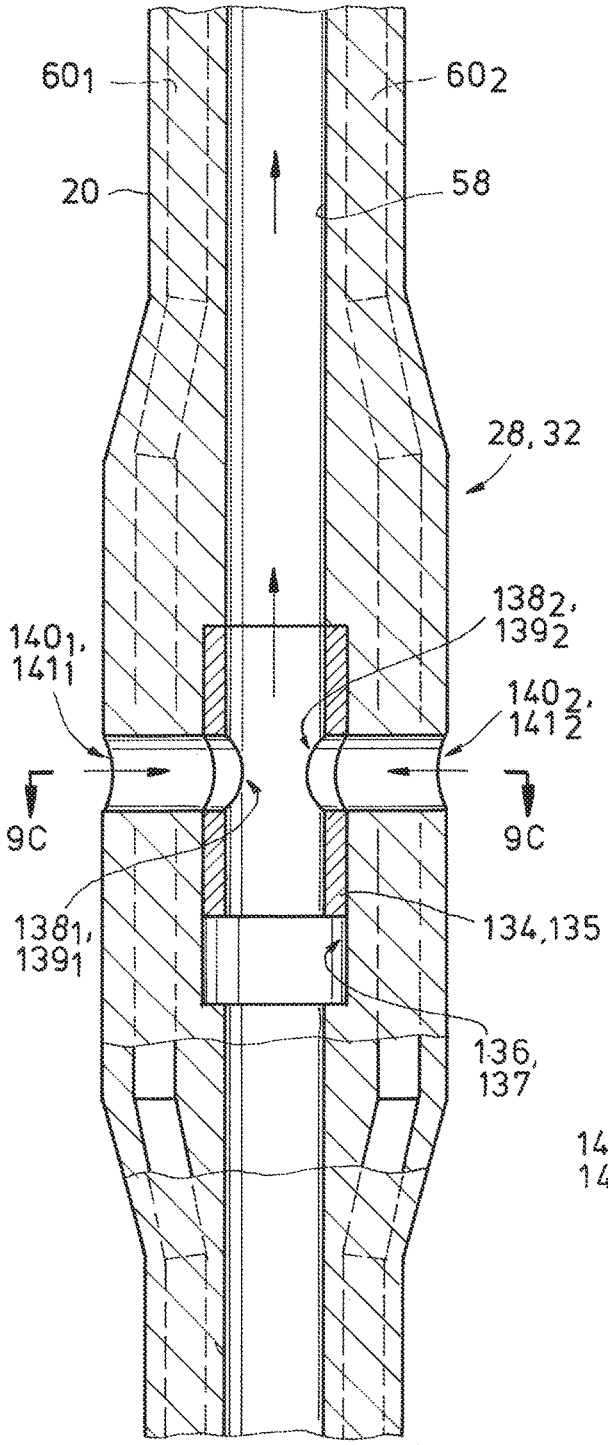
FIGS. 9A-9D are side and axial sectional views of examples of control subs for use with the tool string of FIG. 1 and in accordance with the present invention.
Figure 9B:
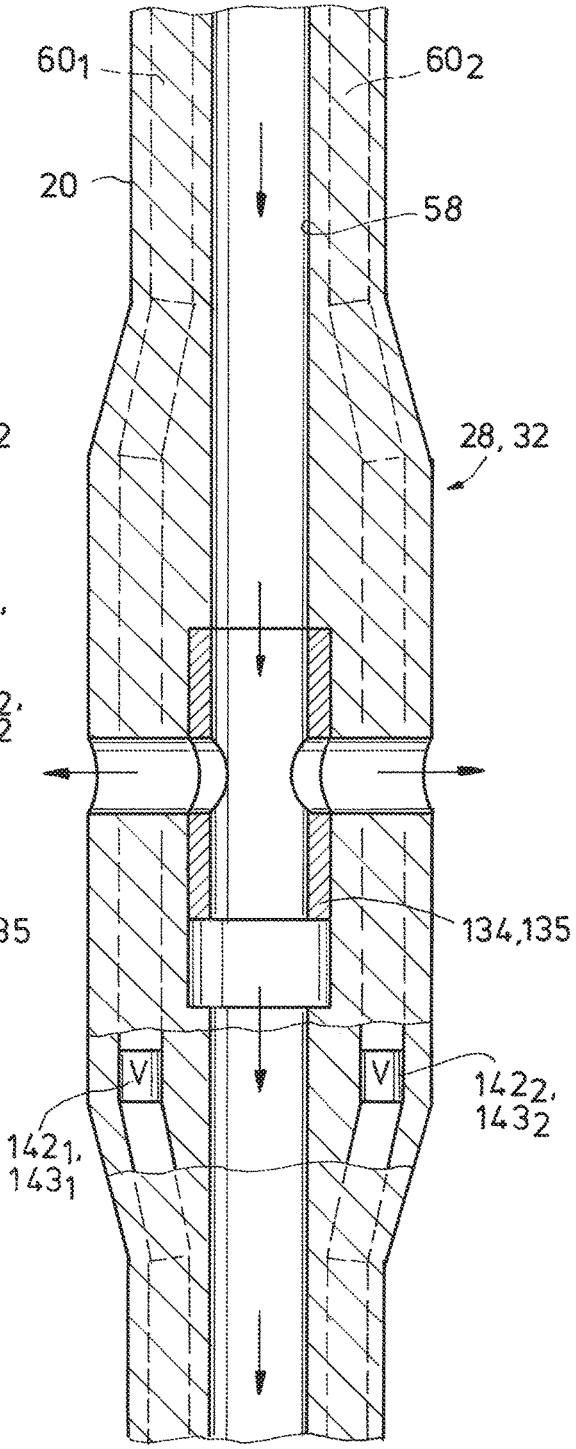
Figure 9D:
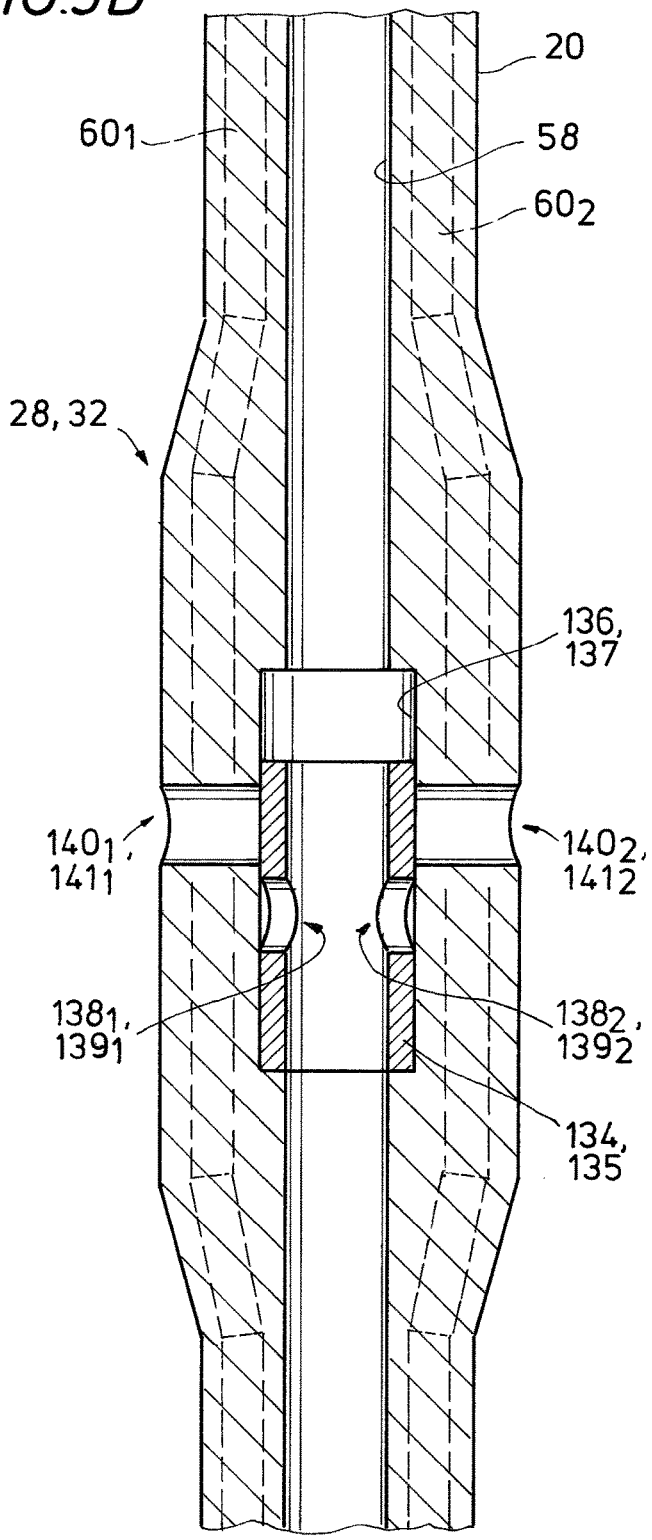
Figure 9C:
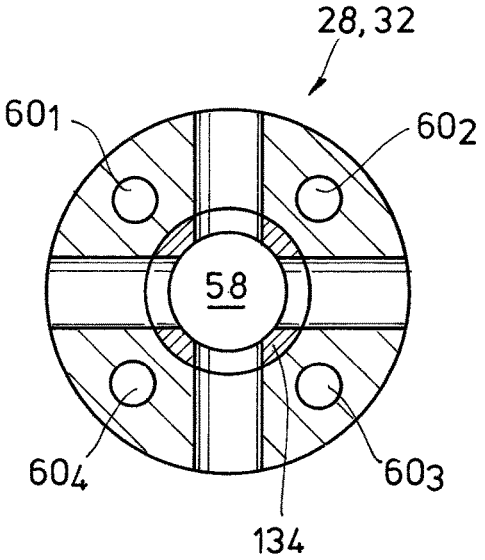

FIGS. 9A through 9D illustrate axial and side sectional views of examples of the inflow control subs 28, 32. FIGS. 9A and 9B illustrate the inflow control subs 28, 32 in an open flow situation so that annular sleeves 134, 135 are shown set in recesses 136 in main bore 58. Because subs 28, 32, have similar components, for the sake of brevity the subs 28, 32 are represented in the same figures and with the reference numerals for both subs 28, 32 provided and separated by a comma. For example, sleeve 134 is associated with control sub 28, and sleeve 135 is associated with control sub 32. Further in this example, sleeves 134, 135 are provided with side openings $\mathbf{138}_1$, $\mathbf{139}_1$, $\mathbf{138}_2$, $\mathbf{139}_2$ that extend radially through their sidewalls. Subscripts provided with the callout numbers are meant illustrate association with one of the four lateral bores $\mathbf{60}_{1\text{-}4}$. However, it should be pointed out that the devices and methods described herein are not limited to four lateral bores $\mathbf{60}_{1\text{-}4}$, but can include less than, or more than four. The sleeves 134, 135 are positioned so that openings $\mathbf{138}_1$, $\mathbf{139}_1$, $\mathbf{138}_2$, $\mathbf{139}_2$ register with side ports $\mathbf{140}_1$, $\mathbf{141}_1$, $\mathbf{140}_2$, $\mathbf{141}_2$ formed radially through the outer walls of inflow control subs 28, 32. As such, fluid and pressure communication is provided between main bore 58 and outer surface of inflow control subs 28, 32. Optionally, as shown in FIG. 9B, isolation valves $\mathbf{142}_1$, $\mathbf{143}_1$, $\mathbf{142}_2$, $\mathbf{143}_2$ may be put respectively in lateral bores $\mathbf{60}_1$, $\mathbf{60}_2$, $\mathbf{60}_3$, $\mathbf{60}_4$ and set axially away from sleeve 134; isolation valves $\mathbf{142}_1$, $\mathbf{143}_1$, $\mathbf{142}_2$, $\mathbf{143}_2$ selectively block axial flow through lateral bore $\mathbf{60}_1$, $\mathbf{60}_2$, $\mathbf{60}_3$, $\mathbf{60}_4$. In the axial sectional view of FIG. 9C (taken along lines 9C-9C of FIG. 9A), each of lateral bores $\mathbf{60}_1$, $\mathbf{60}_2$, $\mathbf{60}_3$ and $\mathbf{60}_4$ are shown formed through the body of inflow control subs 28, 32. A closed configuration of the inflow control subs 28, 32 is shown in side sectional view of FIG. 9D wherein sleeves 134, 135 are moved axially downward within recesses 136, 137 so that openings $\mathbf{138}_1$, $\mathbf{139}_1$, $\mathbf{138}_2$ $\mathbf{139}_2$ are out of registration with side ports $\mathbf{140}_1$, $\mathbf{141}_1$, $\mathbf{140}_2$, $\mathbf{141}_2$ thereby blocking fluid and pressure communication from main bore 58 and outer surface of the inflow control subs 28, 32. Here, bores $\mathbf{60}_1$, $\mathbf{60}_2$ do not intersect with side ports $\mathbf{140}_1$, $\mathbf{141}_1$, $\mathbf{140}_2$, $\mathbf{141}_2$, but are spaced radially away as shown in FIG. 9C, and are thus shown in dashed outline in FIGS. 9A, 9B, and 9D.

Figure 10A:
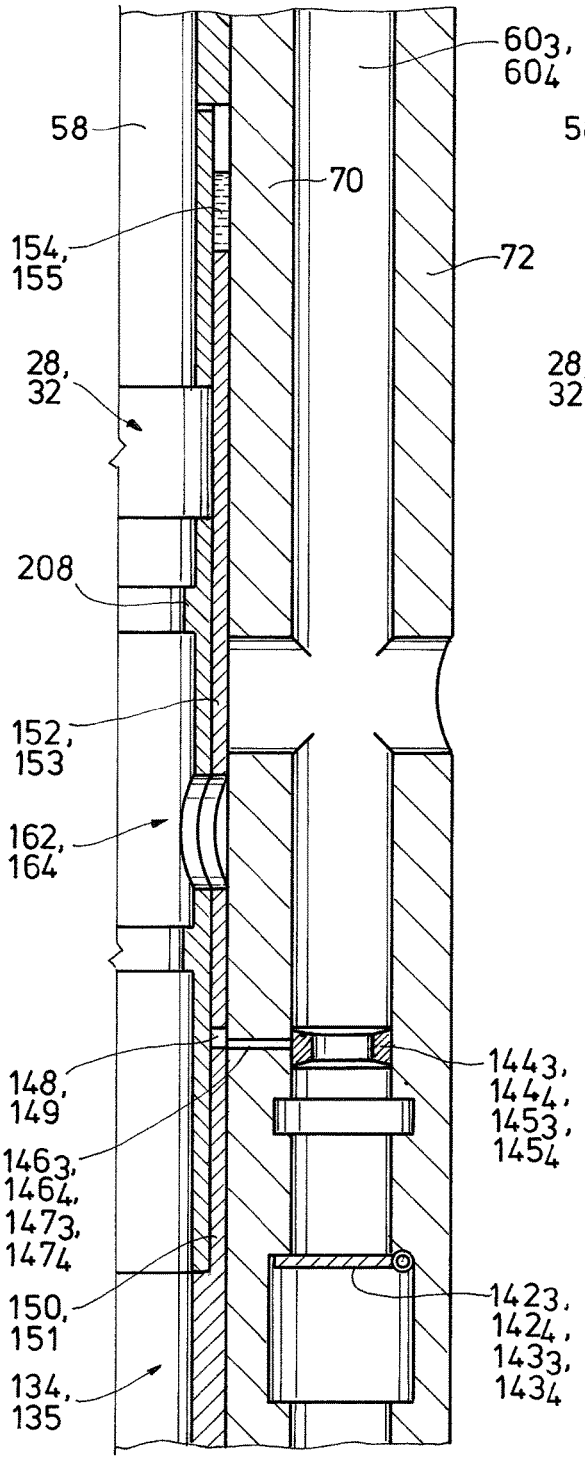
FIGS. 10A-10D and 11A-11C are side sectional views of an example of use of the control subs of FIGS. 9A-9D and in accordance with the present invention.

FIG. 10A through 10D show in a side sectional view one example of opening the sleeves of the inflow control sub 28 and inflow control sub 32. As the working concepts of inflow control subs 28, 32 are similar, their discussion is being consolidated herein. In this example, each lateral bore $\mathbf{60}_3$, $\mathbf{60}_4$ is equipped with a isolation valve $\mathbf{142}_3$, $\mathbf{142}_4$, which is shown in a closed configuration and in the illustrated embodiment is a flapper type valve. Above isolation valve $\mathbf{142}_3$, $\mathbf{142}_4$ are ring-like ball seats $\mathbf{144}_3$, $\mathbf{144}_4$, $\mathbf{145}_3$, $\mathbf{145}_4$ shown set coaxially within the lateral bore $\mathbf{60}_3$, $\mathbf{60}_4$ and outer surfaces in contact with the wall of bore $\mathbf{60}_3$, $\mathbf{60}_4$. Further in the example as illustrated in FIG. 10A, the ball seats $\mathbf{144}_3$, $\mathbf{144}_4$, $\mathbf{145}_3$, $\mathbf{145}_4$ are set adjacent passages $\mathbf{146}_3$, $\mathbf{146}_4$, $\mathbf{147}_3$, $\mathbf{147}_4$ that projects radially through the wall of the inflow control sub 28, 32. In the example embodiments of 10A-10D sleeves 134, 135 are made up of inner collars 150, 151 and pistons 152, 153. Passages $\mathbf{146}_3$, $\mathbf{146}_4$, $\mathbf{147}_3$, $\mathbf{147}_4$ intersect with an annulus 148, 149 formed between the inner wall of tubular 70 and an inner collar 150, 151, where inner collar 150, 151 is axially movable within main bore 58. In the examples of FIG. 10A through 10D, collar 150, 151 is similar in structure and operation to the sleeve 134 of FIG. 9A through 9D. An annular piston 152, 153 is set in the annulus 148, 149, and is axially moveable within annulus 148, 149. Further illustrated in FIG. 10A is a liquid chemical tracer 154, 155 set in a portion of annulus 148, 149 axially distal from passages $\mathbf{146}_3$, $\mathbf{146}_4$, $\mathbf{147}_3$, $\mathbf{147}_4$.

Figure 10B:
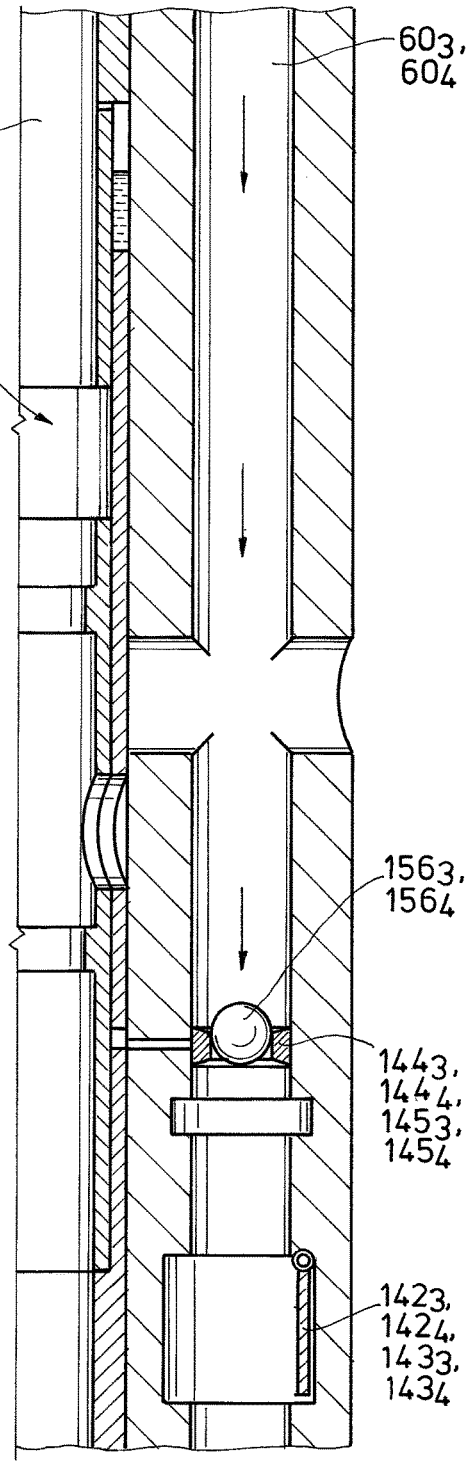
Figure 10C:
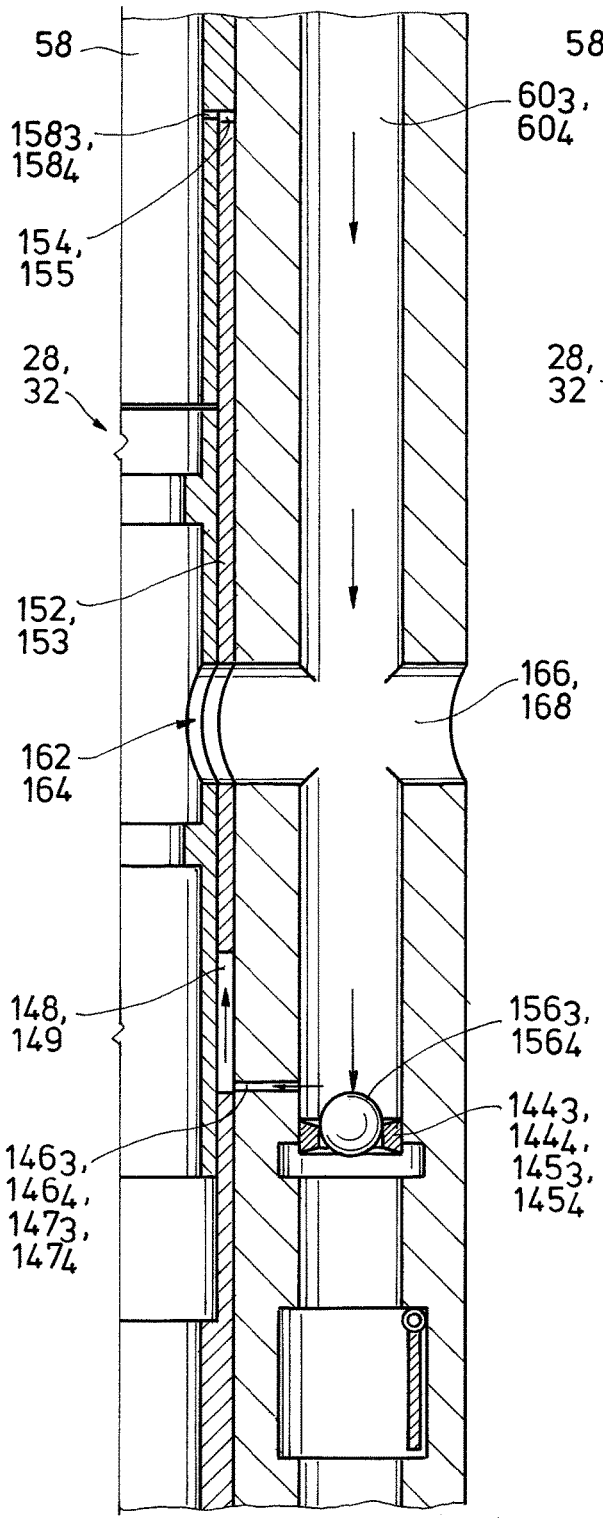
Figure 10D:
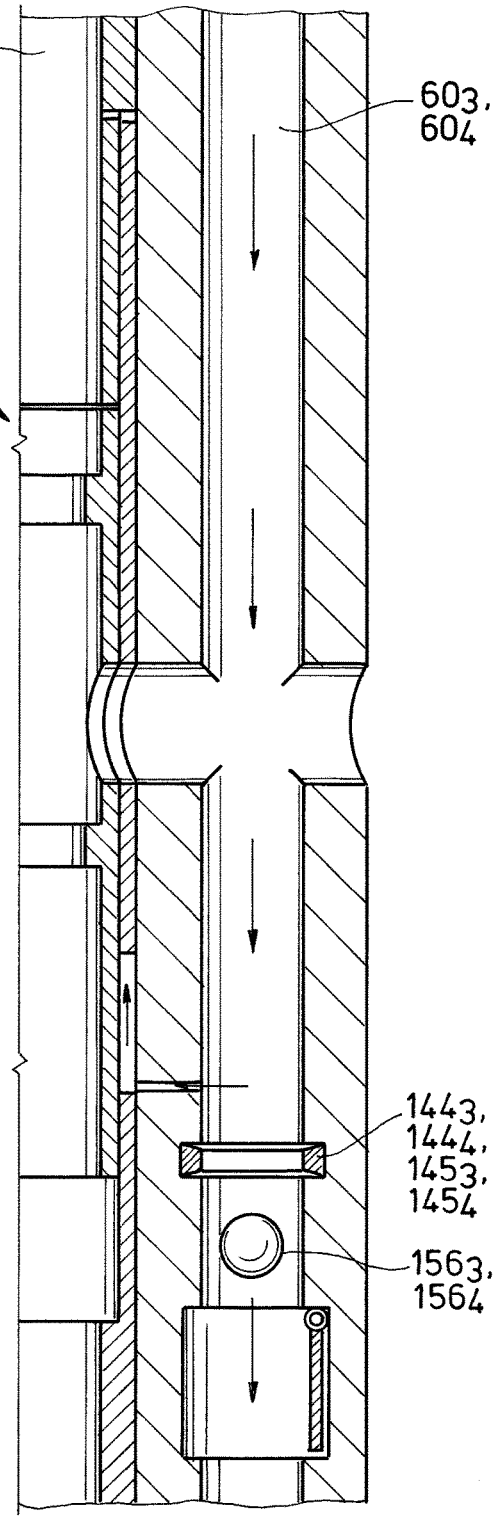

Referring to FIG. 10B, shown are balls $\mathbf{156}_3$, $\mathbf{156}_4$ having been dropped in lateral bore $\mathbf{60}_3$, $\mathbf{60}_4$ and which land in ball seats $\mathbf{144}_3$, $\mathbf{144}_4$, $\mathbf{145}_3$, $\mathbf{145}_4$. In an example, a sealing interface is between balls $\mathbf{156}_3$, $\mathbf{156}_4$ and ball seats $\mathbf{144}_3$, $\mathbf{144}_4$, $\mathbf{145}_3$, $\mathbf{145}_4$. With added pressure in lateral bore $\mathbf{60}_3$, $\mathbf{60}_4$, and as shown in FIG. 10C, balls $\mathbf{156}_3$, $\mathbf{156}_4$ urges ball seats $\mathbf{144}_3$, $\mathbf{144}_4$, $\mathbf{145}_3$, $\mathbf{145}_4$ axially downward and away from passages $\mathbf{146}_3$, $\mathbf{146}_4$, $\mathbf{147}_3$, $\mathbf{147}_4$. By displacing ball seats $\mathbf{144}_3$, $\mathbf{144}_4$, $\mathbf{145}_3$, $\mathbf{145}_4$ away from passages $\mathbf{146}_3$, $\mathbf{146}_4$, $\mathbf{147}_3$, $\mathbf{147}_4$ fluid communication is provided between lateral bores $\mathbf{60}_3$, $\mathbf{60}_4$ and annuli 148, 149 through passages $\mathbf{146}_3$, $\mathbf{146}_4$, $\mathbf{147}_3$, $\mathbf{147}_4$. With sufficient pressure in annulus 148, 149 supplied from lateral bore $\mathbf{60}_3$, $\mathbf{60}_4$, and which communicates from bore $\mathbf{60}_3$, $\mathbf{60}_4$ to annulus 148, 149 via passages $\mathbf{146}_3$, $\mathbf{146}_4$, $\mathbf{147}_3$, $\mathbf{147}_4$ piston 152, 153 is urged axially in a direction towards chemical tracer 154, 155 thereby urging tracer 154, 155 radially outward and through a discharge port $\mathbf{158}_3$, $\mathbf{158}_4$ and into main bore 58. In one example, fluid at surface within main bore 58 can be analyzed for presence of the chemical tracer 154, 155 thereby confirming that ball seats $\mathbf{144}_3$, $\mathbf{144}_4$, $\mathbf{145}_3$, $\mathbf{145}_4$ have moved away from their positions of FIG. 10D. With continued pressure being applied above ball $\mathbf{156}_3$, $\mathbf{156}_4$ and within lateral bore $\mathbf{60}_3$, $\mathbf{60}_4$, ball seats $\mathbf{144}_3$, $\mathbf{144}_4$, $\mathbf{145}_3$, $\mathbf{145}_4$ are moved axially downward and adjacent recesses $\mathbf{160}_3$, $\mathbf{160}_4$ shown formed in outer wall of lateral bore $\mathbf{60}_3$, $\mathbf{60}_4$. Ball seats $\mathbf{144}_3$, $\mathbf{144}_4$, $\mathbf{145}_3$, $\mathbf{145}_4$ then projects radially outward into recess $\mathbf{160}_3$, $\mathbf{160}_4$ and out of interfering contact with balls $\mathbf{156}_3$, $\mathbf{156}_4$ and allowing balls $\mathbf{156}_3$, $\mathbf{156}_4$ to continue its downward travel through lateral bore $\mathbf{60}_3$, $\mathbf{60}_4$. When sleeves 134, 135 are in the open position, bore 58 is in fluid communication with the annular space between tool string 10 and wellbore 12 (FIG. 1) respectively via openings 162, 164 and ports 166, 168. Thus fluid can be injected into the annular space from the subs 28, 32, or fluid from the formation 14 can be produced through the tool string 10 through the openings formed in these subs 28, 32 as described above. Thus by selectively deploying packers 26, 30, 34, and opening/closing subs 28, 32 as described above, designated zones 40, 42, 44 can be tested, treated (such as by injecting fluid from the subs 28, 32, produced, or combinations thereof.

Figure 11A:
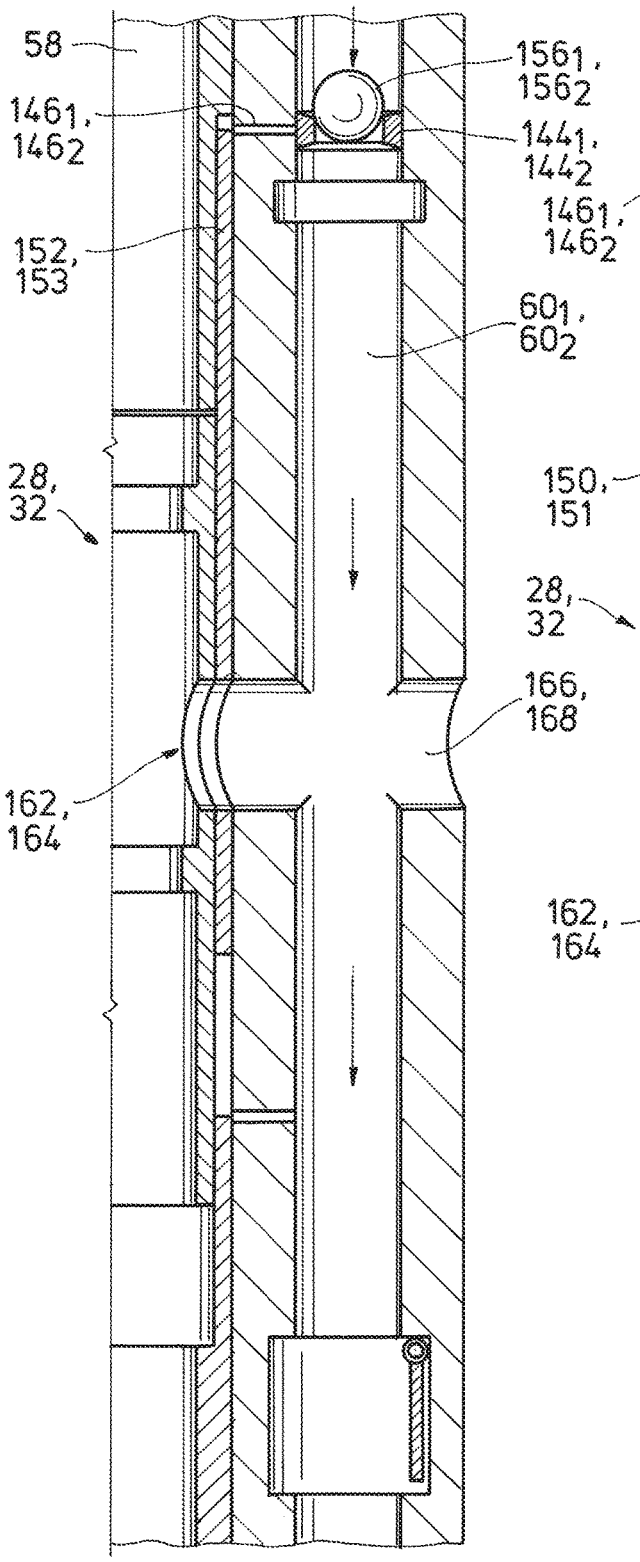
Figure 11B:
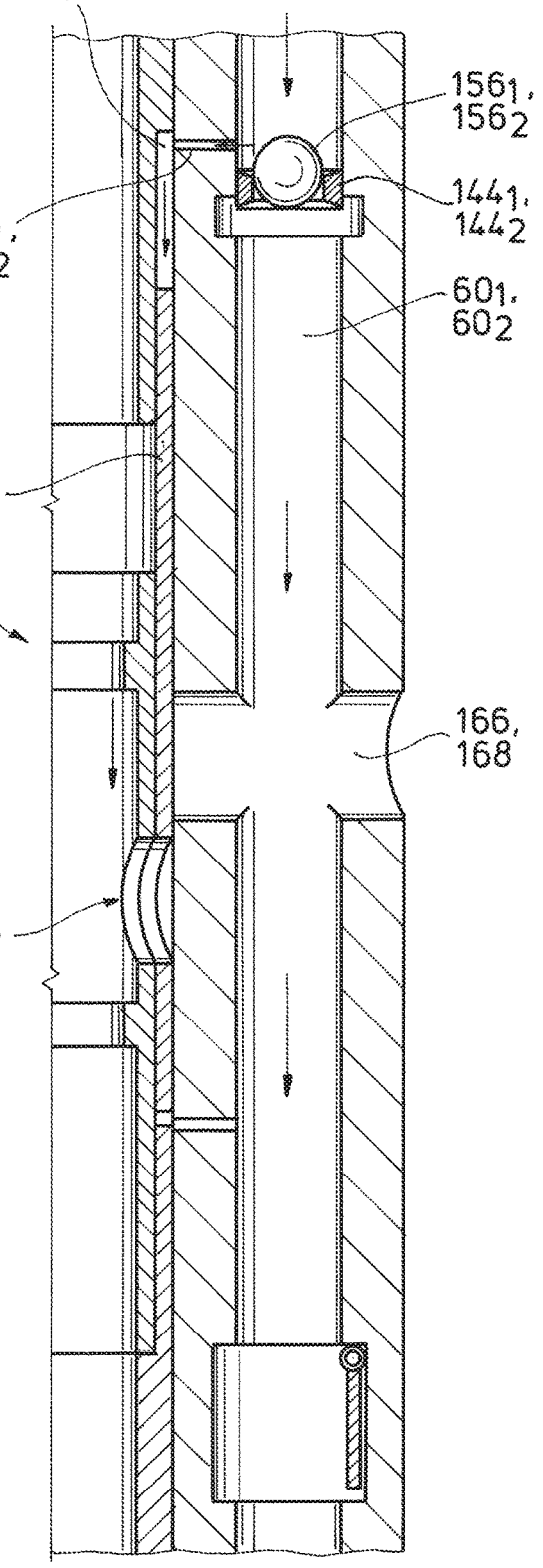
Figure 11C:
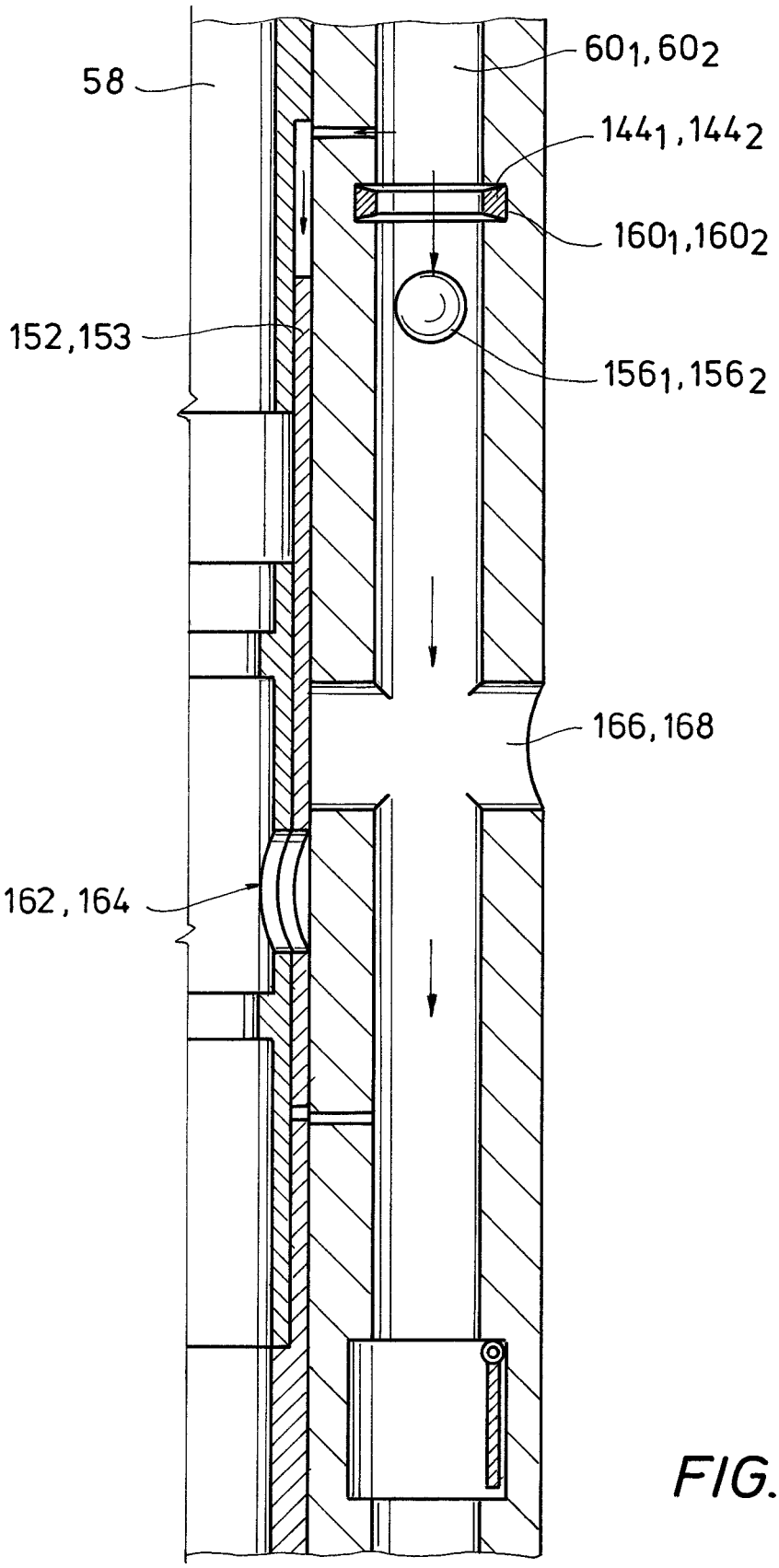

In FIGS. 11A through 11C illustrate in side sectional view an example of how sleeve 134 of FIG. 9A through 9B can be moved back into a closed position, as represented in FIG. 9B. In this example, ball $\mathbf{156}_1$, $\mathbf{156}_2$ is dropped within lateral bore $\mathbf{60}_1$, $\mathbf{60}_2$ and falls into contact with ball seats $\mathbf{144}_1$, $\mathbf{144}_2$, $\mathbf{145}_3$, $\mathbf{145}_4$ which are shown at an axial distance above location of piston 152, 153 when in the open configuration. Referring back to FIG. 10A, portions of pistons 152, 153 have an opening 162, 164 radially formed through their sidewalls that register with ports 166, 168 in wall of control sub 28, 32 when piston 152, 153 are moved axially by fluid pressure within annuli 148, 149. Referring back to FIG. 11B, continued pressure in lateral bore $\mathbf{60}_1$, $\mathbf{60}_2$ forces a ball seats $\mathbf{144}_1$, $\mathbf{144}_2$, $\mathbf{145}_3$, $\mathbf{145}_4$ away from a position adjacent passages $\mathbf{146}_1$, $\mathbf{146}_2$, $\mathbf{147}_3$, $\mathbf{147}_4$. This allows fluid in lateral bore $\mathbf{60}_1$, $\mathbf{60}_2$ to flow through passages $\mathbf{146}_1$, $\mathbf{146}_2$, $\mathbf{147}_3$, $\mathbf{147}_4$ and into annuli 148, 149 and move pistons 152, 153 axially downward. Moving pistons 152, 153 axially downward moves openings 162, 164 out of registration with ports 166, 168; thereby reconfiguring inflow control subs 28, 32 into a closed position. Further pressure in lateral bore $\mathbf{60}_1$, $\mathbf{60}_2$, as shown in FIG. 11C, urges ball seat $\mathbf{144}_1$, $\mathbf{144}_2$ into recess $\mathbf{160}_1$, $\mathbf{160}_2$ and out of interfering contact with ball $\mathbf{156}_1$, $\mathbf{156}_2$ so it can continue its travel downward within lateral bores $\mathbf{60}_1$, $\mathbf{60}_2$. Balls $\mathbf{156}_1$, $\mathbf{156}_2$, $\mathbf{156}_3$, $\mathbf{156}_4$ can be inserted into bores $\mathbf{60}_1$, $\mathbf{60}_2$, $\mathbf{60}_3$, $\mathbf{60}_4$, through ports $\mathbf{54}_1$, $\mathbf{54}_2$, $\mathbf{54}_3$, $\mathbf{54}_4$ (FIG. 3B). In an alternate embodiment, the pressure generated within bores $\mathbf{60}_{1\text{-}4}$ with the balls $\mathbf{156}_{1\text{-}4}$, can be used to inflate the packers 26, 30, 34 as described above.

Figure 12C:
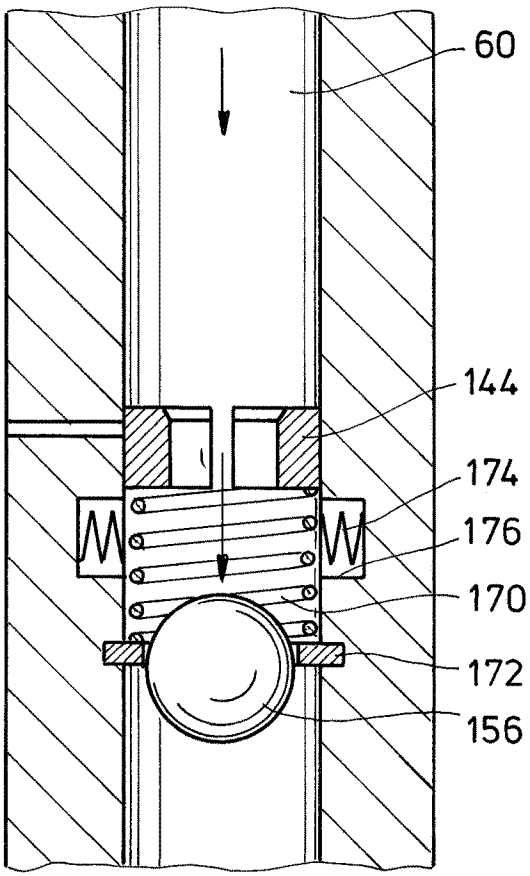
FIGS. 12A-12F are side sectional views of examples of ball seat assemblies for use with the tool string of FIG. 1 and in accordance with the present invention.
Figure 12B:
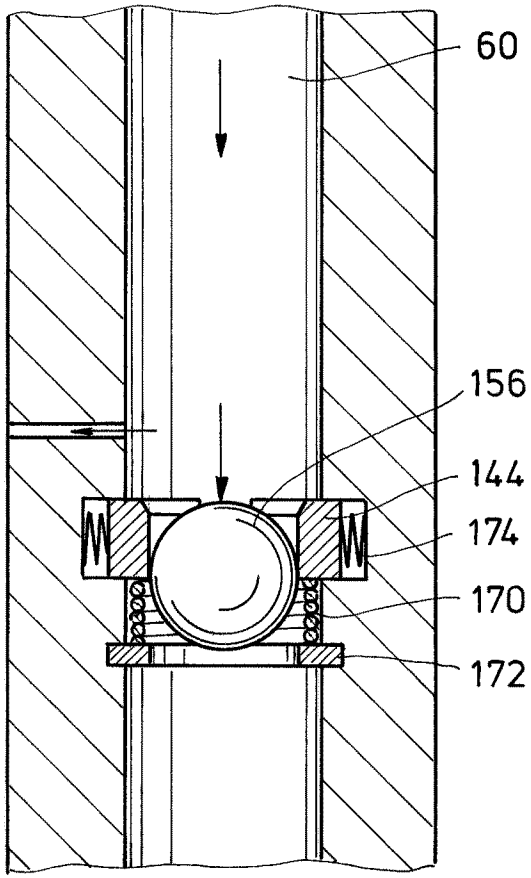
Figure 12A:
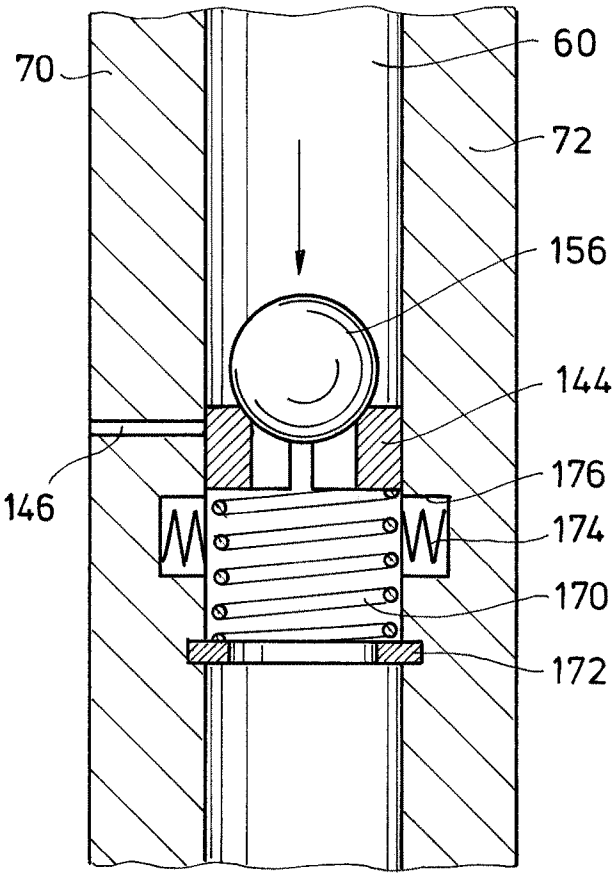
Figure 12F:
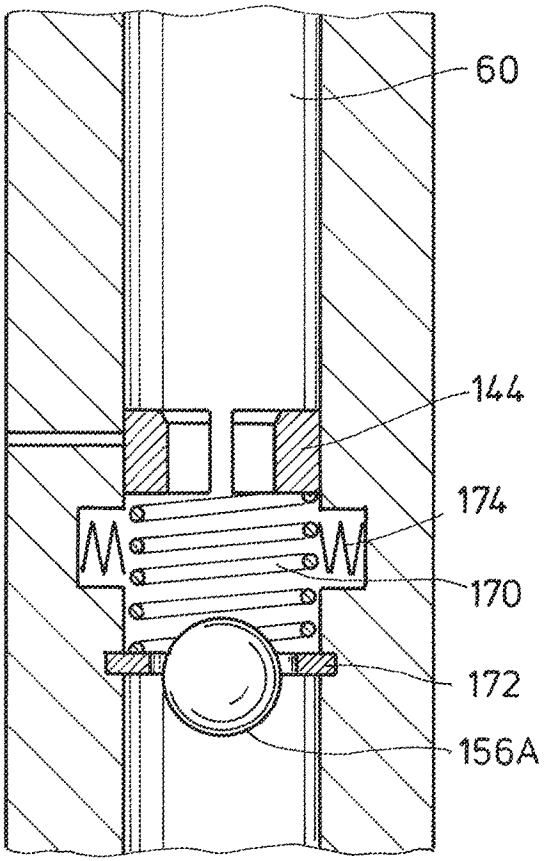
Figure 12E:
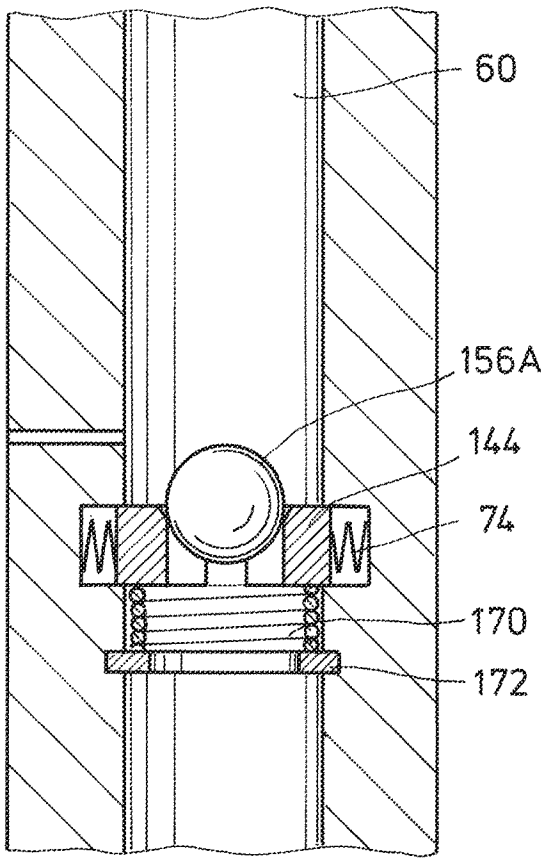
Figure 12D:
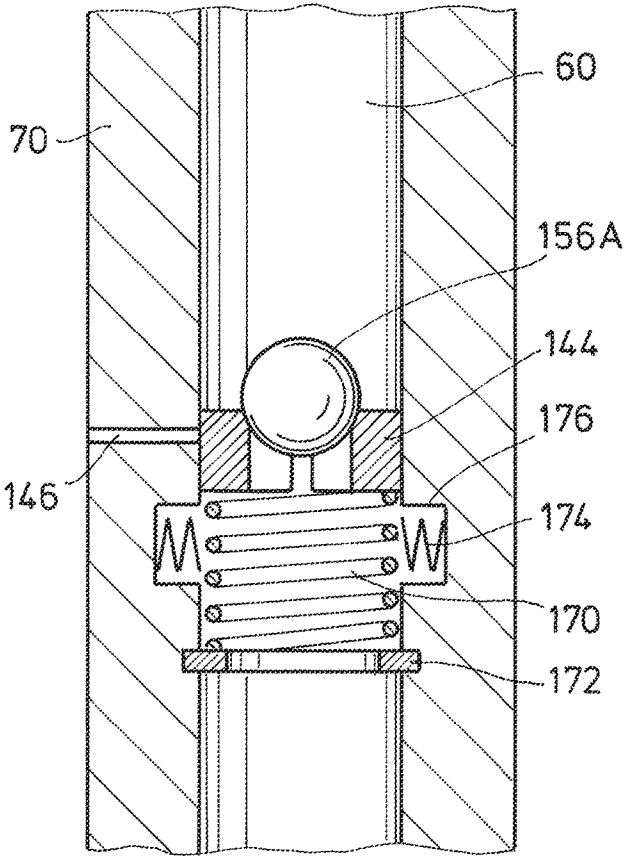

FIG. 12A through 12C illustrate in side sectional view a detailed example of operation of a ball 156 with an example of a ball seat 144. For the sake of brevity, in the examples of FIGS. 12 through 12C, ball seat and associated components are represented as individual elements rather than the multiple ones as illustrated in the above described embodiments. In this example, further included is a spring 170 shown set coaxially within lateral bore 60 and resting on a support ring 172 that anchors within a side wall of lateral bore 60. Further, a spring 174 is shown oriented radially facing the lateral bore 60 and within a recess formed in a ball of tubular 70, 72. As further illustrated in FIGS. 12B and 12C, pressure within lateral bore 60 urges ball 156 against ball seat 144 thereby axially compressing spring 170 between ball seat 144 and ring 172. Ultimately, ball seat 144 reaches recess 176, is urged radially outward into recess 176, and out of interfering contact with ball 156. Disposing ball seat 144 into recess 176 allows ball 156 to fall lower within lateral bore 60. In this example, the spring 174 urges ball seat 144 out of recess 176, so that spring 170 can push ball seat 144 to its position previous to application of pressure in lateral bore 60. FIG. 12D through 12F illustrate a similar operation, however with a ball 156A having a diameter smaller than ball 156 of FIGS. 12A through 12C. In this example of FIGS. 12D through 12F, a reduced amount of time is required to urge ball 156A through the ball seat 144 and springs 170, 174, consequently the piston 152, 153 moves downward such that opening 162, 164 not completely out of registration with port 166, 168, hence half open or half closed.

Figures 13A, 13B, 14A, 14B:
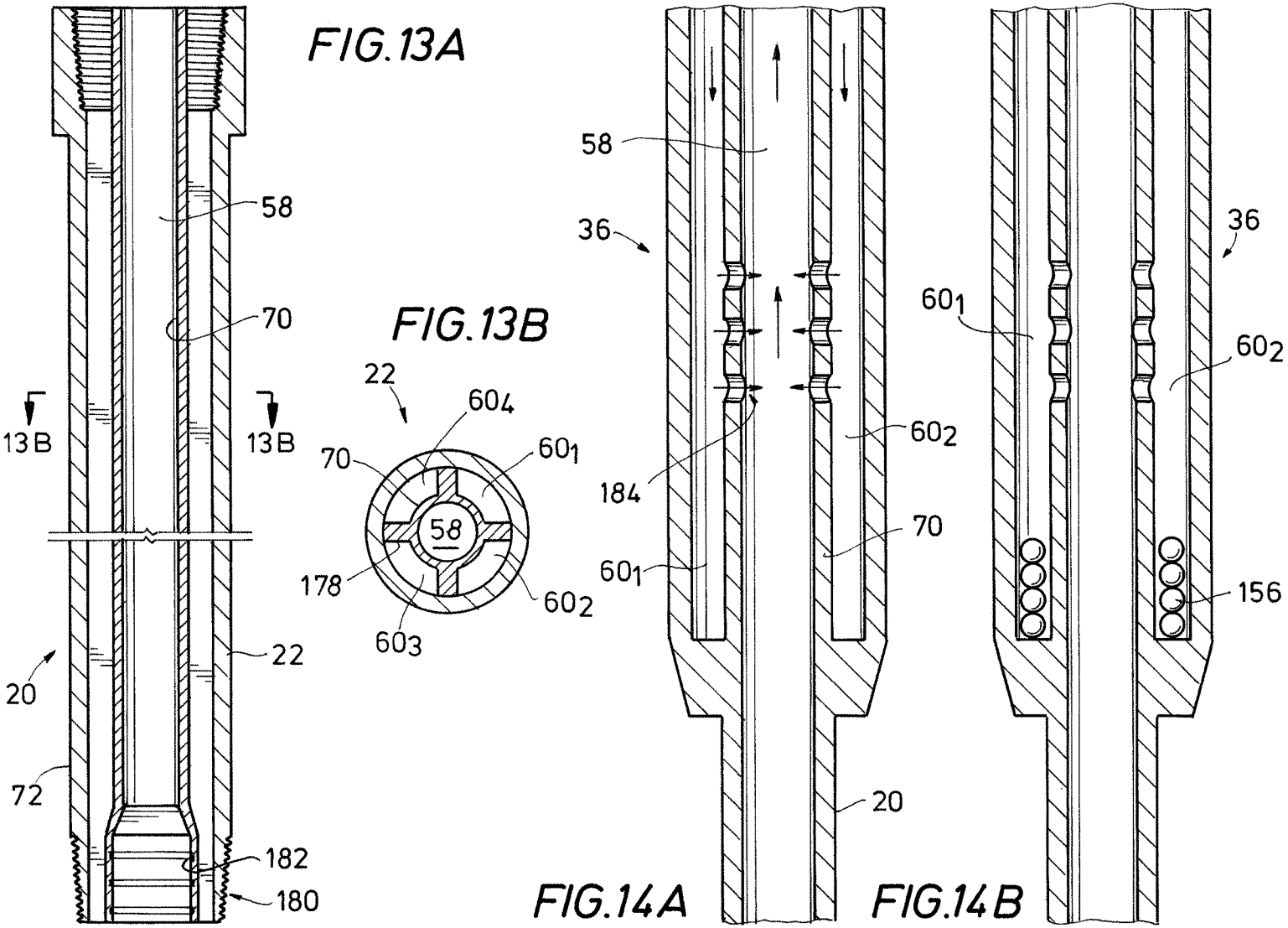
FIGS. 13A and 13B are side and axial sectional views of a dual conduit diverter for use with the tool string of FIG. 1 and in accordance with the present invention.
FIGS. 14A and 14B are side sectional views of an example of a diverter sub for use with the tool string of FIG. 1 and in accordance with the present invention.

FIGS. 13A and 13B shown respectively in side sectional and axial sectional view an example of a portion of dual-wall tubing string 20 with a cross section 22 as shown in FIG. 13B, wherein in FIG. 13A, the inner tubular 70 has a diameter that projects radially outward proximate the lower end of the dual-wall tubing string 20. Moreover, outer tubular 72 is provided with threads 180 on an outer surface proximate the lower terminal end, and O ring seals 182 are shown set on an inner circumference of inner tubular 70 proximate lower end. FIG. 13B, taken along lines 13B-13B of FIG. 13A illustrates that in one portion of dual-wall tubing 20, supports 178 extend radially between inner tubular and outer tubular 70, 72 and define the boundaries between lateral bores $\mathbf{60}_1$, $\mathbf{60}_2$, $\mathbf{60}_3$, $\mathbf{60}_4$.

A side sectional view of one example of bottom diverter sub 36 is shown in FIGS. 14A and 14B. In the example of FIG. 14A, a series of radial apertures 184 are formed through inner tubular 70 so that flow within lateral bores $\mathbf{60}_1$, $\mathbf{60}_2$ can make its way into main bore 58 and circulate from a downward flow into an upward flow back to surface. In FIG. 14B, balls 156 are shown collected in lower respected ends of lateral bores $\mathbf{60}_1$, $\mathbf{60}_2$.

Figures 15A, 15B, 15C, 15D, 15E:
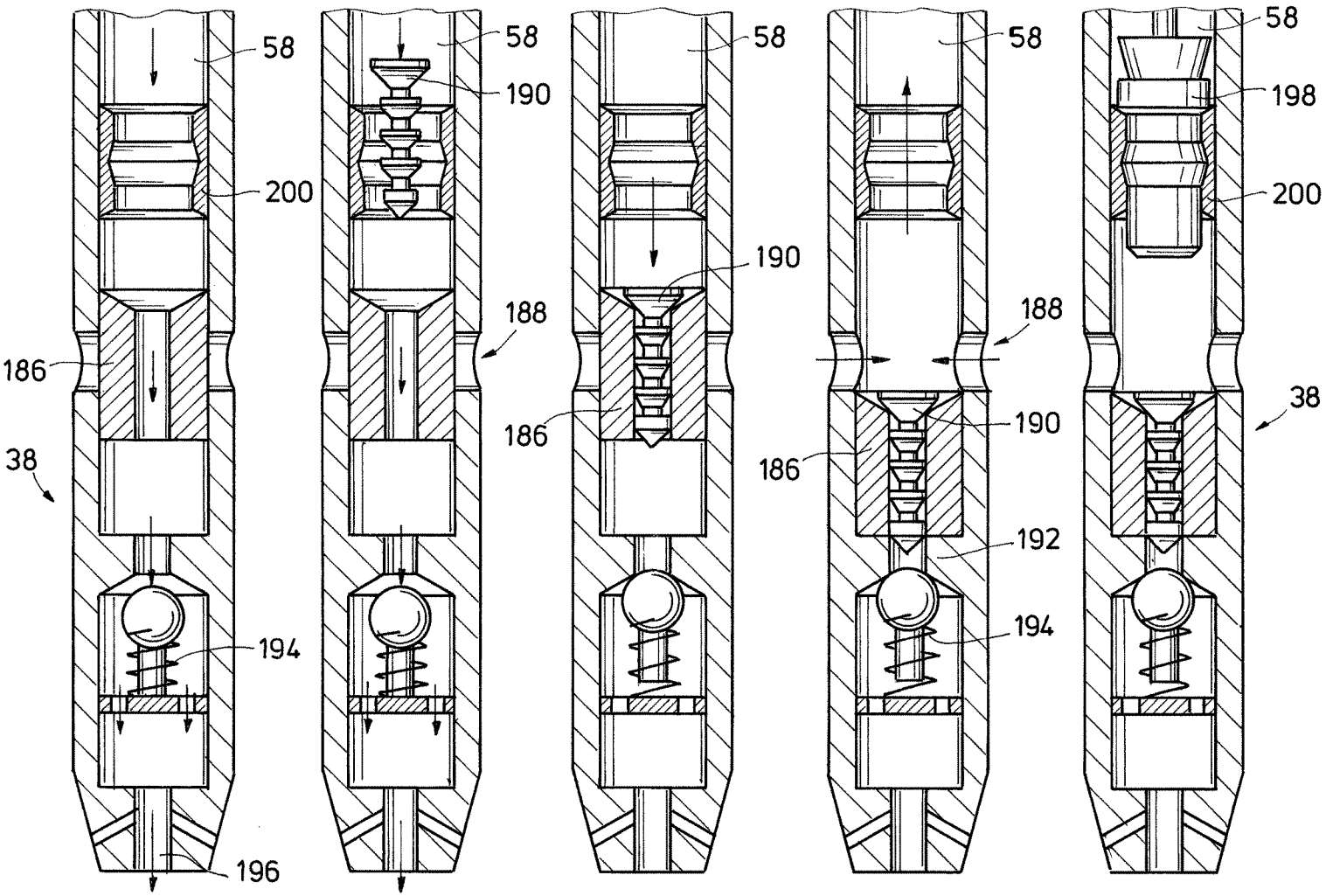
FIGS. 15A-15E are side sectional views of an example of operation of a bottom sub for use with the tool string of FIG. 1 and in accordance with the present invention.

FIGS. 15A through 15E show side sectional views of operational stages of an example of the bottom sub 38 with float. Referring to FIG. 15A, bottom sub is equipped with a sliding sleeve 186 coaxially set within the main bore 58 and adjacent side ports 188 formed radially through a side wall of the bottom sub 38. As illustrated in FIG. 15B, a dart 190 is dropped within main bore 58 so that it lands in sleeve 186 as illustrated in FIG. 15C. With added pressure applied in main bore 58, sleeve 186 is moved axially downward and lands on shoulders 192 defined where the diameter of main bore 58 transitions radially inward. A spring loaded float 194 is shown set below shoulders 192, that when pressure is applied through the bottom sub 38, float 194 is contracted and allows flow through the sub 38 and out a bottom port 196 on the lower end of bottom sub 38. With the presence of dart 190 blocking flow through the bottom sub 58, the spring loaded float 194 extends axially upward and provides a seal against a lower end of shoulder 192 and so that flow from outside of bottom sub 38 can make its way through side ports 188 and up the main bore 58. Finally, as shown in FIG. 15E, a bridge plug 198 can be set in a profile 200 in the main bore portion of the bottom sub 38.

Referring back to FIG. 1, in a non-limiting example of operation, the tool string 10 is deployed in the wellbore 12 so that testing or production can take place in one or more of the zones 40, 42, 44 at the same or different times. Moreover, the tool string 10 can test in or produce from an open hole (non-cased), and from multiple zones. During make up of tool string 10 and while it is being run into hole, circulation of fluid can be provided through the main bore 58 and lateral bores $\mathbf{60}_1$, $\mathbf{60}_2$, $\mathbf{60}_3$, $\mathbf{60}_4$. Clean fluid can be circulated to fill the annulus in the dual conduit diverter 22 and portion of tubing string 20 having dual wall. The bridge plug 198 can be set in the bottom sub 38, and the main bore 58 can be pressure tested against the isolation valves $\mathbf{143}_1$, $\mathbf{143}_2$ (FIG. 9B). Wireline or slickline 202 can be used to set the bridge plug 198. Tubing hanger 52 can be set at this time and tie down bolts can be tightened. When the tool string 10 of FIG. 1 is set, the dart 190 (FIG. 15B) is dropped into bottom sub 38. Lateral bores $\mathbf{60}_1$, $\mathbf{60}_2$, $\mathbf{60}_3$, $\mathbf{60}_4$ are pressure tested, and balls $\mathbf{156}_1$, $\mathbf{156}_2$, $\mathbf{156}_3$, $\mathbf{156}_4$ can be dropped to selectively open and close ports of the inflow control subs 28, 32 (FIGS. 10A-10D and FIGS. 11A-11C). Pressure via lateral bores $\mathbf{60}_1$, $\mathbf{60}_2$, $\mathbf{60}_3$, $\mathbf{60}_4$ can be applied to selectively set zonal isolation packers. Tubing casing annulus can be pressured tested to verify that top cased hole packer is set. A wireline or slickline device (not shown) can be deployed to open sliding sleeve above packer 26 for displacing packer fluid. After adding a packer fluid of designated weight, the sliding sleeve can be closed. Tubing bridge plug 198 (FIG. 15E) can be set by wireline or slickline. After ensuring there is no wellhead pressure, a blowout preventer (not shown) can be rigged down, and a tubing bonnet and production tree can be added and pressure tested. The bridge plug is retried and the rig released.

Additional steps of the example operation include rigging up and pressure testing surface well test equipment (i.e. flow line, pressure manifold, separator, flare stack, pumps, etc). Production tubing can be pressurized from wellhead assembly 46 (FIG. 2) to open ports at bottom sub 38 (FIG. 15A). Light fluid can be circulated through lateral bores $\mathbf{60}_1$, $\mathbf{60}_2$, $\mathbf{60}_3$, $\mathbf{60}_4$ to act as a cushion for lifting well. Flow can be delivered to a lower zone for clean out, and an optional acid squeeze can be performed as well as a test for injectivity. If required, mini-frac may alternatively be performed to bypass a near wellbore damaged zone. A retrievable tubing bridge plug 198 and be run and set in the bottom sub 38 to close off lower zone, and the plug can be pressure tested from surface. Middle inflow control sub 28 (FIGS. 10A-10D) can be closed by dropping ball 156 into appropriate bore $\mathbf{60}_1$, $\mathbf{60}_2$, $\mathbf{60}_3$, $\mathbf{60}_4$. Prior to this step, light fluid may again be optionally circulated through dual conduit annulus to act as a cushion for lifting well and for testing middle zone. After this step, flow can be delivered to the middle zone for clean out, and an optional acid squeeze can be performed as well as a test for injectivity. If required, mini-frac may alternatively be performed to bypass a near wellbore damaged zone. Middle zone inflow control sub 32 can be closed by the dropping of appropriate ball and pumping down fluid on the ball. Optionally, a safety joint (not shown) can be installed above the cased hole packer 26 (FIG. 1) so that the dual conduit tubing system can be retrieved if well is abandoned after well testing. In an example the safety joint is installed with a simple workover rig (not shown). Alternate embodiments exist wherein the tool string 10 includes additional packers, inflow control subs, and/or diverter subs.

In an example, the tool string 10 operates as a replacement for downhole drill string test equipment, and can operate in multiple zones without an oil rig. In an example, the tool string 10 can perform well control operations during deployment and test phase, and be useful in well killing operations. The tool string 10 can replace the need for coiled tubing as it can circulate light fluid therethrough.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A tool string for use in a wellbore comprising:

a tubing string;

a main bore axially formed in the tubing string;

lateral bores disposed radially outward from the main bore and that are axially formed in a sidewall of the tubing string;

an inlet formed radially through the sidewall of the tubing that intersects at least one of the lateral bores;

a packer on the tubing string that is selectively expandable into sealing contact with a wall of the wellbore to define a pressure barrier in an annulus between the tubing string and the wall of the wellbore;

an inflow control sub on the tubing string comprising, ports projecting radially through the sidewall from the main bore to an outer surface of the tubing string, and a sleeve coaxially slidable in the main bore with openings that selectively register with the ports to provide communication between the main bore and the outer surface of the tubing string; and an actuator in a one of the lateral bores and that is coupled with the inflow control sub and that selectively delivers an axial sliding force to the sleeve.

2. The tool string of claim 1, wherein the actuator comprises an annular seat coaxially disposed in the one of the lateral bores, a passage that projects radially through the tubing string between the one of the lateral bores and to adjacent the sleeve, so that when the seat is moved axially away from the passage, pressure from the one of the lateral bores communicates to the sleeve to urge the sleeve axially to an open position so that the openings register with the ports.

3. The tool string of claim 2, further comprising an annular piston coupled with the sleeve and that has an end in communication with the passage, so that when the pressure from the one of the lateral bores communicates to the sleeve, an axial force is applied to the piston for urging the piston that in turn urges the sleeve to the open position.

4. The tool string of claim 3, further comprising an annular space on an end of the piston distal from the end that is in communication with the passage, a chemical tracer in the annular space, and a discharge port projecting radially through the sleeve adjacent the annular space, so that when the piston is urged by the axial force, the chemical tracer is injected into the main bore.

5. The tool string of claim 2, further comprising a recess in the sidewall spaced axially away from the passage and that selectively receives the seat within.

6. The tool string of claim 5, further comprising a spring that axially biases seat, so that when the seat is received within the recess and expands radially outward, a ball landed on the seat passes through the seat and the spring urges the seat to an original location above the recess.

7. The tool string of claim 2, wherein when a ball is dropped into the one of the lateral bores and lands on the seat, a fluid seal is formed between the ball and the seat, so that when pressure is applied to a space above the ball, a force is generated to urge the ball and the seat axially within the one of the lateral bores.

8. The tool string of claim 1, wherein the actuator comprises an annular seat coaxially disposed in the one of the lateral bores, a passage that projects radially through the tubing string between the one of the lateral bores and to adjacent the sleeve, so that when the seat is moved axially away from the passage, pressure from the one of the lateral bores communicates to the sleeve to urge the sleeve axially to a closed position so that the openings are moved out of registration with the ports.

9. The tool string of claim 8, further comprising an annular piston coupled with the sleeve and that has an end in communication with the passage, so that when the pressure from the one of the lateral bores communicates to the sleeve, an axial force is applied to the piston for urging the piston that in turn urges the sleeve to the closed position.

10. The tool string of claim 1, further comprising inlet ports at upper ends of the lateral bores and that selectively receive balls that are dropped into the lateral bores.

11. The tool string of claim 1, further comprising a sleeve assembly having an upper sleeve having slots in a sidewall that selectively register with radial ports formed in the sidewall of the tubing string.

12. The tool string of claim 1, wherein the packer comprises a casing packer having an elastomeric member that projects radially outward and into sealing contact with an inner surface of casing in the wellbore.

13. The tool string of claim 1, wherein the packer comprises an open hole packer having an elastomeric member that projects radially outward and into sealing contact with an uncased surface of the wellbore.

14. The tool string of claim 13, further comprising a valve between the main bore and a space inside of the elastomeric member, wherein the valve comprises a plug having a side facing the main bore, compressible disks on a side of the plug opposite the main bore, a spring axially disposed in a chamber formed the sidewall of the main bore and adjacent the compressible disks, so that when pressure in the main bore exceeds a designated pressure, a radially outward force is exerted onto the plug to compress the disks and urge the plug adjacent the spring, wherein the spring axially urges the plug into an opening and blocks communication between the main bore and the space inside of the elastomeric member.

15. A method of using a tool string in a wellbore comprising:

providing a tubing string having, a main bore, lateral bores extending axially in a sidewall of the tubing string and each having an end disposed adjacent a wellhead assembly, a packer in selective communication with the main bore, and a flow sub;

disposing the tubing string into the wellbore; and selectively creating a path of communication between the main bore and an annulus between the tubing string and wellbore by pressurizing a one of the lateral bores.

16. The method of claim 15, wherein the one of the lateral bores comprises a first lateral bore, the method further comprising inserting a ball into an upper end of the first bore and that lands in a ball seat provided in the first bore.

17. The method of claim 15, wherein the step of pressurizing communicates pressure in the one of the lateral bores to a piston that couples to a sleeve that circumscribes the main bore, so that the communicated pressure axially urges the sleeve to a location that registers an opening in the sleeve with a port in the tubing string thereby communicating the main bore with the annulus.

18. The method of claim 17, further comprising injecting fluid into the annulus through the flow sub.

19. The method of claim 18, wherein the step of communicating pressure comprises providing a pressure actuated valve in the sidewall of the tubing string that actuates at a designated pressure.

20. The method of claim 17, further comprising producing fluid from the annulus into the flow sub.

21. The method of claim 15, further comprising deploying the packer by communicating pressure in the one of the lateral bores to a space between the packer and the tubing string.

* * * * *